United States Patent [19]

Naito et al.

[11] Patent Number: 4,500,626

[45] **Date of Patent: * Feb. 19, 1985**

[54] HEAT-DEVELOPABLE COLOR PHOTOGRAPHIC MATERIAL

[75] Inventors: Hideki Naito; Hiroshi Hara; Toshiaki Aono; Kozo Sato; Shinsaku Fujita, all of Kanagawa, Japan

[73] Assignee: Fuji Photo Film Co., Ltd., Kanagawa, Japan

[ * ] Notice: The portion of the term of this patent subsequent to Jul. 31, 2001 has been disclaimed.

[21] Appl. No.: 431,861

[22] Filed: Sep. 30, 1982

[30] Foreign Application Priority Data

Oct. 2, 1981 [JP] Japan ..... 56-157798

[51] Int. Cl.[3] ..... G03C 5/54; G03C 1/40

[52] U.S. Cl. ..... 430/203; 430/223; 430/351; 430/559; 430/619

[58] Field of Search ..... 430/203, 223, 351, 619, 430/617, 618, 559

[56] References Cited

U.S. PATENT DOCUMENTS 3,761,279 9/1973 de Mauriac et al. ..... 430/351
4,021,240 5/1977 Cerquone et al. ..... 430/203
4,022,617 5/1977 McGuckin ..... 430/203

FOREIGN PATENT DOCUMENTS 2058383 4/1981 United Kingdom ..... 430/617

OTHER PUBLICATIONS

"Positive Images in Photothermographic Materials", Kohrt, *Research Disclosure,* No. 16408, 12/1977, pp. 15 & 16.

*Primary Examiner*—Richard L. Schilling
*Attorney, Agent, or Firm*—Sughrue, Mion, Zinn, Macpeak, and Seas

[57] ABSTRACT

A heat-developable color photographic material is disclosed. The material is comprised of a support having thereon a layer containing at least a light-sensitive silver halide, a hydrophilic binder, a dye releasing activator and a dye releasing compound which reduces the silver halide and releases a hydrophilic dye. The heat-developable color photographic material can easily provide a clear and stable color image by imagewise exposure to light and a heat-development procedure. A method of forming a color image using the heat-developable color photographic material is also disclosed.

40 Claims, No Drawings

HEAT-DEVELOPABLE COLOR PHOTOGRAPHIC MATERIAL

FIELD OF THE INVENTION

The present invention relates to a process of forming a color image by heat-development. Particularly, the present invention relates to a novel process for obtaining a color image by diffusion transfer of a dye released upon heat-development of a heat-developable color photographic material containing a dye releasing compound which releases a hydrophilic diffusible dye upon heat-development into a support which has a mordant layer.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In recent years, with respect to image formation processes for photographic materials using silver halide, many techniques capable of easily and quickly obtaining images have been developed by changing the conventional wet process using a developing solution into a dry development process such as a process using heat, etc.

Heat-developable photographic materials are known in the field of these techniques. Heat-developable photographic materials and processes therefor have been described in U.S. Pat. Nos. 3,152,904, 3,301,678, 3,392,020 and 3,457,075, British Pat. Nos. 1,131,108 and 1,167,777, and *Research Disclosure,* No. 17029, pages 9 to 15 (June, 1978).

Many different processes for obtaining color images have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure,* pages 31 and 32 (Sept., 1975) and the combination of a sulfonamidophenol type reducing agent and a 4-equivalent couplder as described in U.S. Pat. No. 4,021,240. These processes, however, are disadvantageous in that turbid color images are formed, because a reduced silver image and a color image are simultaneously formed on the exposed area after heat-development. In order to eliminate these disadvantages, there have been proposed a process which comprises removing a silver image by liquid processing or a process which comprises transferring only the dye to another layer, for example, a sheet having an image receiving layer. However, the latter process is not desirable because it is not easy to transfer only the dye as distinguishable from unreacted substances.

Another process which comprises introducing a nitrogen containing heterocyclic group into a dye, forming a silver salt and releasing a dye by heat-development has been described in *Research Disclosure, No.* 16966, pages 54 to 58 (May, 1978). According to this process, clear images cannot be obtained, because it is difficult to control the release of dyes from nonexposed areas, and thus it is not a conventionally applicable process.

Also, processes for forming a positive color image by a silver dye bleach process utilizing heat-development, with useful dyes and methods for bleaching have been described, for example, in *Research Disclosure,* No. 14433, pages 30 to 32 (April, 1976), ibid., No. 15227, pages 14 and 15 (Dec., 1976) and U.S. Pat. No. 4,235,957.

However, this process requires an additional step and an additional material for accelerating bleaching of dyes, for example, heating with a superposed sheet with an activating agent. Furthermore, it is not desirable because the resulting color images are gradually reduced and bleached by coexisting free silver during long periods of preservation.

Moreover, a process for forming a color image utilizing a leuco dye has been described, for example, in U.S. Pat. Nos. 3,985,565 and 4,022,617. However, this process is not desirable because it is difficult to stably incorporate the leuco dye in the photographic material and coloration gradually occurs during preservation.

SUMMARY OF THE INVENTION

The present invention provides a novel process for forming a color image by heat-development, eliminating the drawbacks present in known materials.

Therefore an object of the present invention is to provide a novel process for forming a color image which comprises transferring a hydrophilic dye released upon heat-development into an image receiving material containing a mordant to obtain a color image.

Another object of the present invention is to provide a process for obtaining a clear color image by a simple procedure.

Still another object of the present invention is to provide a process for obtaining a color image which is stable for a long period of time.

These and other objects of the present invention will become more apparent from the following detailed description and examples.

These objects of the present invention are accomplished with a heat-developable color photographic material comprising a support having thereon a layer containing at least a light-sensitive silver halide, a hydrophilic binder, a dye releasing activator and a dye releasing compound which reduces the organic silver salt oxidizing agent and releases a hydrophilic dye.

DETAILED DESCRIPTION OF THE INVENTION

The heat-developable color photographic material of the present invention can simultaneously provide a silver image having a negative-positive relationship to the original and a diffusible dye on the part corresponding to the silver image utilizing only heat-development after imagewise exposure to light. That is, when the heat-developable color photographic material of the present invention is imagewise exposed to light and developed by heating, an oxidation-reduction reaction occurs between an organic silver salt oxidizing agent and a reducing dye releasing compound by means of exposed light-sensitive silver halide as a catalyst to form a silver image in the exposed area. In this step, the dye releasing compound is oxidized by the organic silver salt oxidizing agent to form an oxidized product. This oxidized product is cleaved in the presence of a dye releasing activator and consequently the hydrophilic diffusible dye is released. Accordingly, the silver image and the diffusible dye are formed in the exposed area, and a color image is obtained by transferring the diffusible dye.

The reaction of releasing a diffusible dye according to the present invention is completed with a dye film under high temperature. This releasing reaction of a diffusible dye is believed to be a reaction by the so-called attack with a nucleophilic agent and is usually carried out in a liquid. In the present invention, the compounds which are set forth as preferred examples show a high reaction rate even in the dry film, although the rate varies depending on a kind of the dye releasing compounds. The reaction rates found were unexpectedly high. Further, the dye releasing compound according to the present invention can undergo an oxidation-reduction reaction with silver halide or an organic silver salt oxidizing agent without the assistance of the so-called auxiliary developing agent. This is also an unexpected result based on previous information of what may happen at ambient temperature.

The dye releasing redox compound which releases a hydrophilic diffusible dye used in the present invention is represented by the following general formula (I):

$$R—SO_2—D \quad (I)$$

wherein R represents a reducing group capable of being oxidized by the organic silver salt oxidizing agent, and D represents an image forming dye portion containing a hydrophilic group.

Preferably the reducing group in the dye releasing compound $R—SO_2—D$ has an oxidation-reduction potential to a saturated calomel electrode of 1.2 V or less measuring the polarographic half wave potential using acetonitrile as a solvent and sodium perchlorate as a base electrolyte. Preferred examples of the reducing group include those represented by the following general formulae (II) to (IX).

(II)

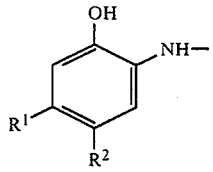

(III)

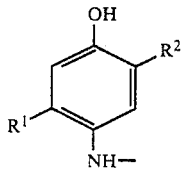

(IV)

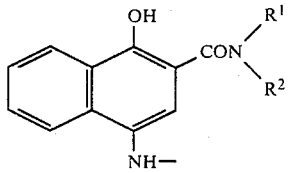

(V)

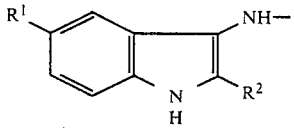

-continued (VI)

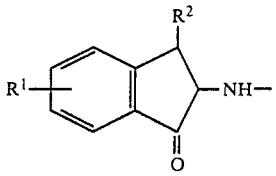

(VII)

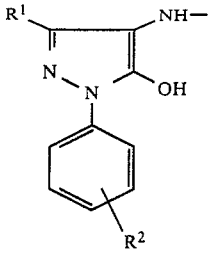

(VIII)

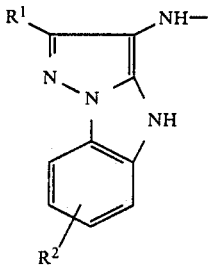

(IX)

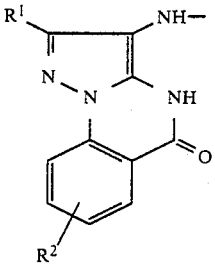

wherein $R^1$ and $R^2$ each represents hydrogen or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group. The alkyl moiety and the aryl moiety in the above described substituents may be further substituted with an alkoxy group, a halogen atom, a hydroxy group, a cyano group, an acyl group, an acylamino group, a substituted carbamoyl group, a substituted sulfamoyl group, an alkylsulfonylamino group, an arylsulfonylamino group, a substituted ureido group or a carboalkoxy group. The total number of the carbon atoms of substituents represented by $R^1$ and $R^2$ is preferably from 8 to 40. Furthermore, the hydroxy group and the amino group included in the reducing group represented by R may be protected by a protective group capable of reproducing the hydroxy group and the amino group by the action of a nucleophilic agent.

In more preferred embodiments of the present invention, the reducing group R is represented by the following general formula (X).

HEAT-DEVELOPABLE COLOR PHOTOGRAPHIC MATERIAL

FIELD OF THE INVENTION

The present invention relates to a process of forming a color image by heat-development. Particularly, the present invention relates to a novel process for obtaining a color image by diffusion transfer of a dye released upon heat-development of a heat-developable color photographic material containing a dye releasing compound which releases a hydrophilic diffusible dye upon heat-development into a support which has a mordant layer.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In recent years, with respect to image formation processes for photographic materials using silver halide, many techniques capable of easily and quickly obtaining images have been developed by changing the conventional wet process using a developing solution into a dry development process such as a process using heat, etc.

Heat-developable photographic materials are known in the field of these techniques. Heat-developable photographic materials and processes therefor have been described in U.S. Pat. Nos. 3,152,904, 3,301,678, 3,392,020 and 3,457,075, British Pat. Nos. 1,131,108 and 1,167,777, and *Research Disclosure,* No. 17029, pages 9 to 15 (June, 1978).

Many different processes for obtaining color images have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure,* pages 31 and 32 (Sept., 1975) and the combination of a sulfonamidophenol type reducing agent and a 4-equivalent couplder as described in U.S. Pat. No. 4,021,240. These processes, however, are disadvantageous in that turbid color images are formed, because a reduced silver image and a color image are simultaneously formed on the exposed area after heat-development. In order to eliminate these disadvantages, there have been proposed a process which comprises removing a silver image by liquid processing or a process which comprises transferring only the dye to another layer, for example, a sheet having an image receiving layer. However, the latter process is not desirable because it is not easy to transfer only the dye as distinguishable from unreacted substances.

Another process which comprises introducing a nitrogen containing heterocyclic group into a dye, forming a silver salt and releasing a dye by heat-development has been described in *Research Disclosure, No.* 16966, pages 54 to 58 (May, 1978). According to this process, clear images cannot be obtained, because it is difficult to control the release of dyes from nonexposed areas, and thus it is not a conventionally applicable process.

Also, processes for forming a positive color image by a silver dye bleach process utilizing heat-development, with useful dyes and methods for bleaching have been described, for example, in *Research Disclosure,* No. 14433, pages 30 to 32 (April, 1976), ibid., No. 15227, pages 14 and 15 (Dec., 1976) and U.S. Pat. No. 4,235,957.

However, this process requires an additional step and an additional material for accelerating bleaching of dyes, for example, heating with a superposed sheet with an activating agent. Furthermore, it is not desirable because the resulting color images are gradually reduced and bleached by coexisting free silver during long periods of preservation.

Moreover, a process for forming a color image utilizing a leuco dye has been described, for example, in U.S. Pat. Nos. 3,985,565 and 4,022,617. However, this process is not desirable because it is difficult to stably incorporate the leuco dye in the photographic material and coloration gradually occurs during preservation.

SUMMARY OF THE INVENTION

The present invention provides a novel process for forming a color image by heat-development, eliminating the drawbacks present in known materials.

Therefore an object of the present invention is to provide a novel process for forming a color image which comprises transferring a hydrophilic dye released upon heat-development into an image receiving material containing a mordant to obtain a color image.

Another object of the present invention is to provide a process for obtaining a clear color image by a simple procedure.

Still another object of the present invention is to provide a process for obtaining a color image which is stable for a long period of time.

These and other objects of the present invention will become more apparent from the following detailed description and examples.

These objects of the present invention are accomplished with a heat-developable color photographic material comprising a support having thereon a layer containing at least a light-sensitive silver halide, a hydrophilic binder, a dye releasing activator and a dye releasing compound which reduces the organic silver salt oxidizing agent and releases a hydrophilic dye.

DETAILED DESCRIPTION OF THE INVENTION

The heat-developable color photographic material of the present invention can simultaneously provide a silver image having a negative-positive relationship to the original and a diffusible dye on the part corresponding to the silver image utilizing only heat-development after imagewise exposure to light. That is, when the heat-developable color photographic material of the present invention is imagewise exposed to light and developed by heating, an oxidation-reduction reaction occurs between an organic silver salt oxidizing agent and a reducing dye releasing compound by means of exposed light-sensitive silver halide as a catalyst to form a silver image in the exposed area. In this step, the dye releasing compound is oxidized by the organic silver salt oxidizing agent to form an oxidized product. This oxidized product is cleaved in the presence of a dye releasing activator and consequently the hydrophilic total number of the carbon atoms included in $R^{20}$, $R^{21}$ and $X^{20}{}_n$ is from 7 to 40.

(XIc)

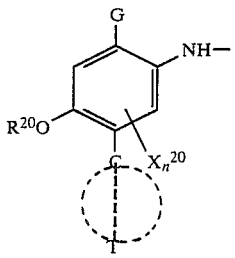

wherein G represents a hydroxy group or a group giving a hydroxy group upon hydrolysis; $R^{20}$ represents an alkyl group or an aromatic group; $X^{20}$ represents an alkyl group, an alkoxy group, an alkylthio group, an arylthio group, a halogen atom or an acylamino group; n is 0, 1 or 2; the group of

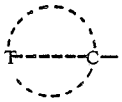

represents a group in which 2 to 4 saturated hydrocarbon rings are condensed, the carbon atom

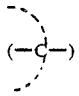

in the condensed ring which is connected to the phenol nucleus (or a precursor thereof), a tertiary carbon atom which composes one pivot of the condensed ring, a part of the carbon atoms (excluding the above described tertiary carbon atom) in the hydrocarbon ring may be substituted for oxygen atom(s), the hydrocarbon ring may have a substituent, and an aromatic ring may be further condensed to the hydrocarbon ring; $R^{20}$ or $X^{20}$ and the group of

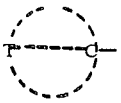

may be bonded to each other to form a condensed ring; and the total number of the carbon atoms included in $R^{20}$, $X^{20}{}_n$ and the group of

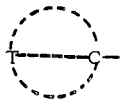

is from 7 to 40.

Specific examples of the reducing groups represented by the above described general formulae (XI), (XIa), (XIb) and (XIc) are described in Japanese Patent Application (OPI) Nos. 16131/81, 650/82 and 4043/82.

The essential part in the groups represented by the general formulae (III) and (IV) is a para(sulfonyl-)aminophenol part. Specific examples of these reducing groups are described in U.S. Pat. Nos. 3,928,312 and 4,076,529, U.S. Published Patent Application B 351,673, U.S. Pat. Nos. 4,135,929 and 4,258,120 (all of which are incorporated herein by reference to disclose reducing groups). These groups are also effective for the reducing group R according to the present invention.

In still other more preferred embodiments of the present invention, the reducing group R is represented by the following general formula (XII).

(XII)

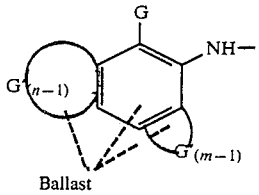

wherein Ballast represents an organic ballasting radical of such molecular size and configuration as to render said compound nondiffusible during development in an alkaline processing composition; G represents a hydroxy group or a group giving a hydroxy group upon hydrolysis; G′ represents an aromatic ring directly condensed to the benzene nucleus to form a naphthalene nucleus; and n and m are dissimilar positive integers of 1 to 2.

Specific examples of the reducing groups represented by the above described general formula (XII) are described in U.S. Pat. No. 4,053,312 (incorporated herein by reference to disclose reducing groups).

The reducing groups represented by the above described general formulae (V), (VII), (VIII) and (IX) are characterized by containing a heterocyclic ring. Specific examples of the groups are described in U.S. Pat. Nos. 4,198,235 and 4,273,855 (incorporated herein by reference to disclose these groups), Japanese Patent Application (OPI) No. 46730/78.

Specific examples of the reducing groups represented by the general formula (VI) are described in U.S. Pat. No. 4,149,892 (incorporated herein by reference to disclose there groups).

Characteristics required for the reducing group R as follows.

1. It is rapidly oxidized by the organic silver salt oxidizing agent to effectively release a diffusible dye for image formation by the function of the dye releasing activator.
2. The reducing group R has an extensive hydrophobic property, because it is necessary for the dye releasing compound to be immobilized in a hydrophilic or hydrophobic binder and that only the released dye have diffusibility.
3. It has excellent stability to heat and to the dye releasing activator and does not release the image forming dye until it is oxidized; and
4. It is easily synthesized.

In the following, specific examples of preferred reducing groups R which satisfy the above described requirements are shown. In the example, NH— represents the bond to the dye portion.

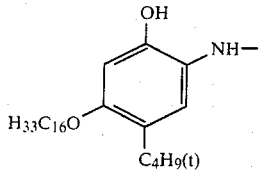
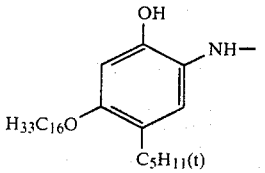
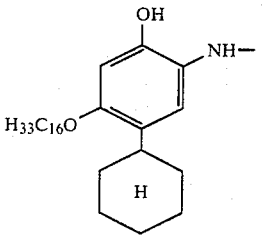
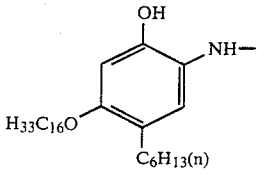
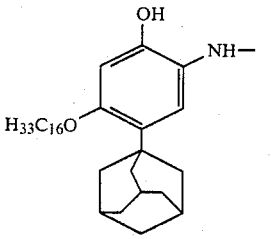
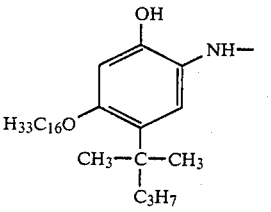
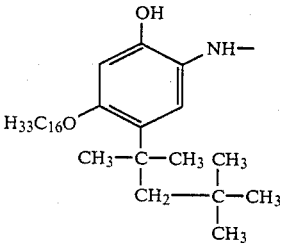
-continued
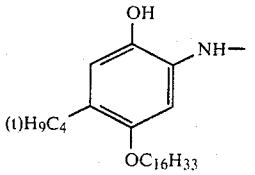
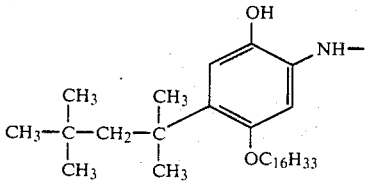
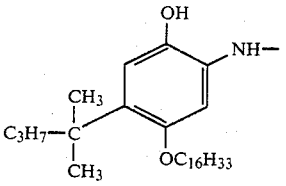
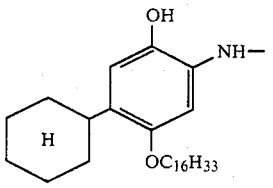
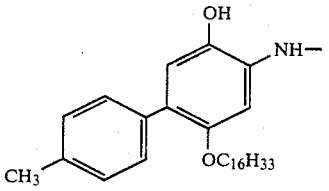
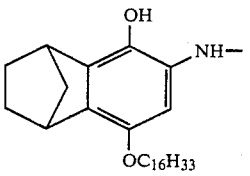
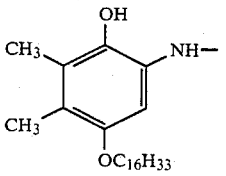
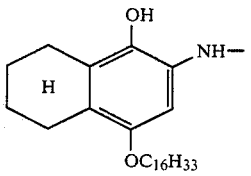

-continued

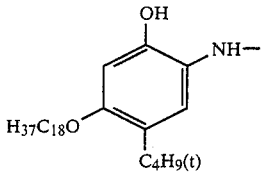

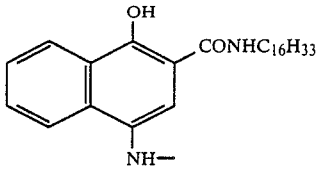

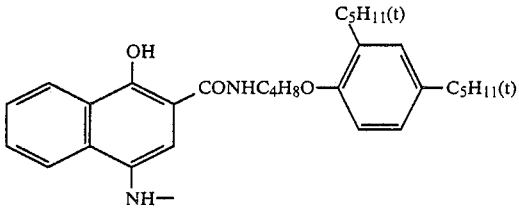

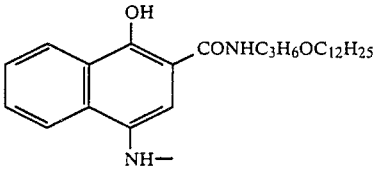

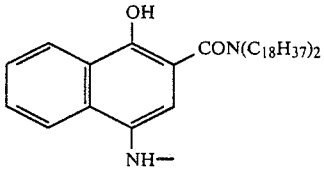

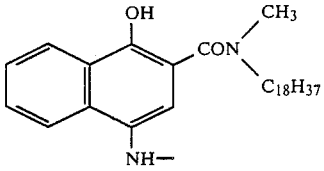

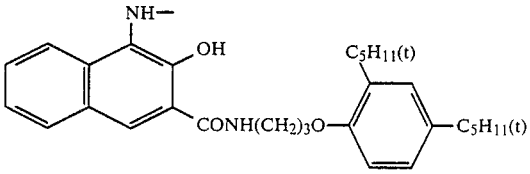

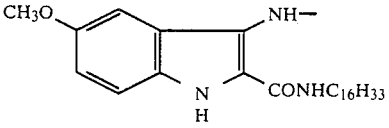

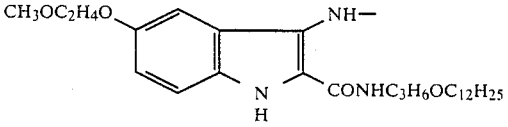

-continued

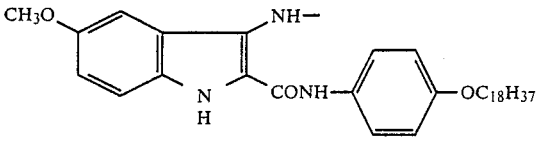

Examples of dyes which can be used for image forming dyes include azo dyes, azomethine dyes, anthraquinone dyes, naphthoquinone dyes, styryl dyes, nitro dyes, quinoline dyes, carbonyl dyes and phthalocyanine dyes, etc. Representative examples of them are set forth below and are classified by hue. Further, these dyes can be used in a temporarily blue shifted form which is capable of regeneration during the development processing.

Yellow:

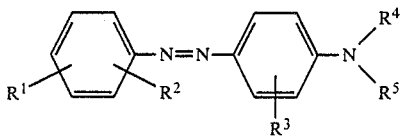

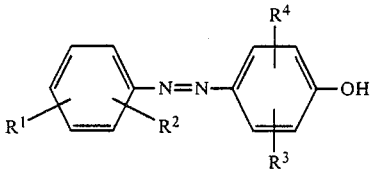

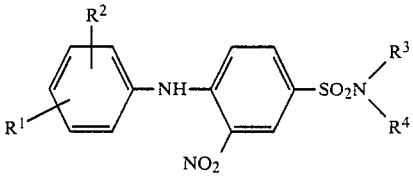

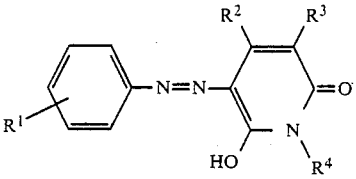

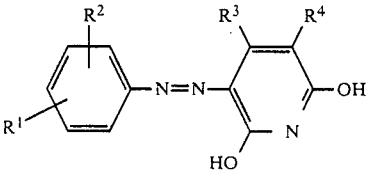

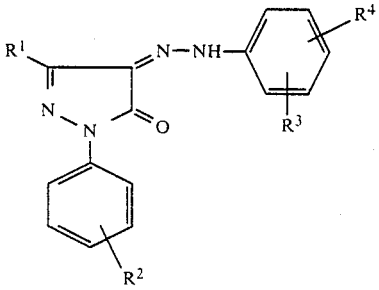

-continued
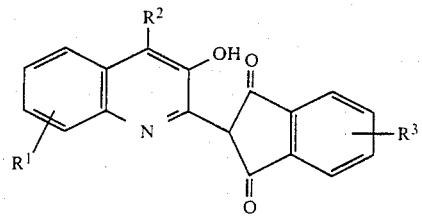
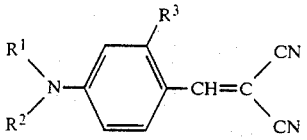
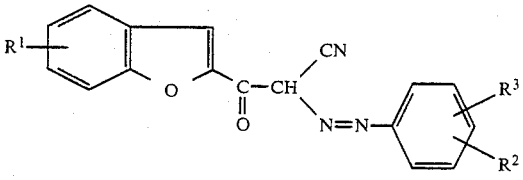
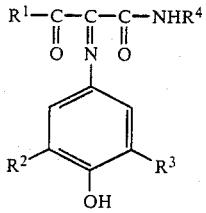
Magenta:
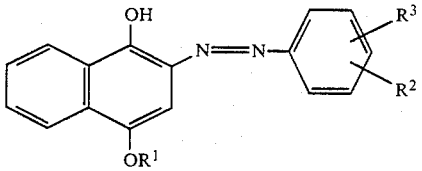
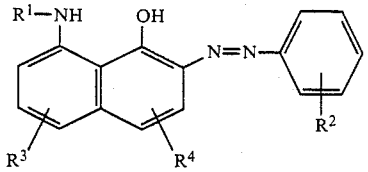
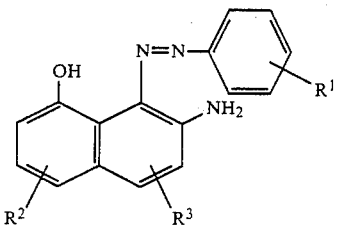
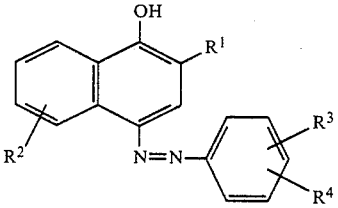
-continued
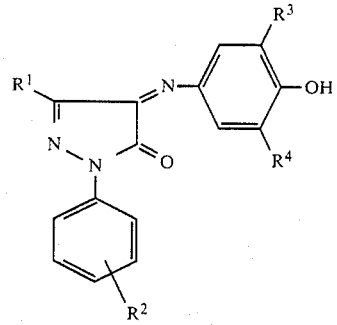
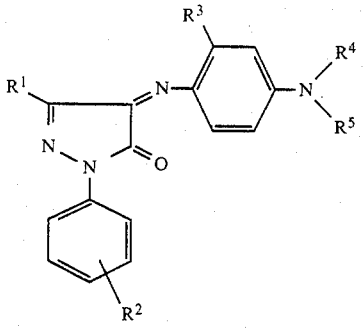
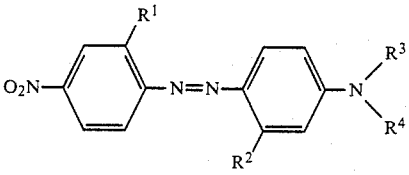
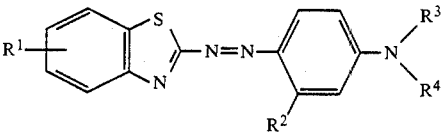
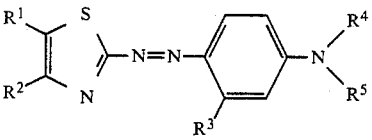
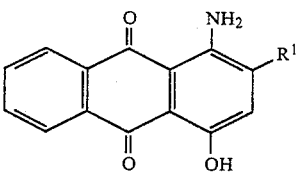
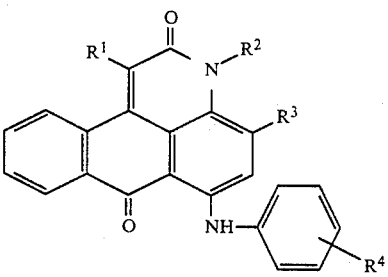

-continued
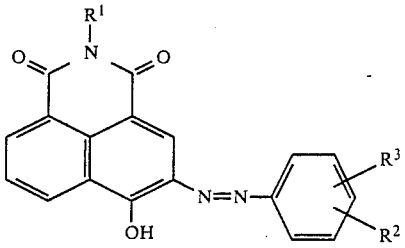
Cyan:
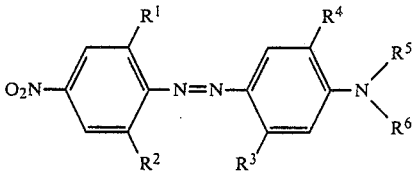
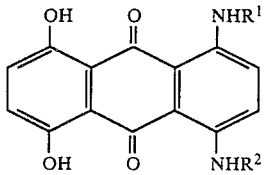
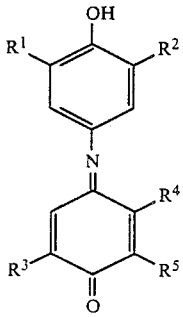
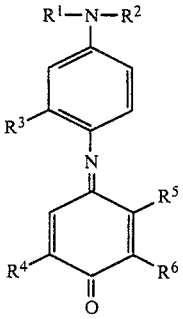
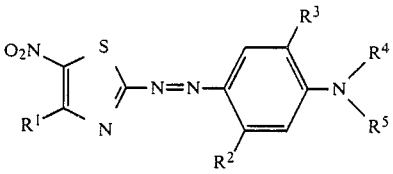
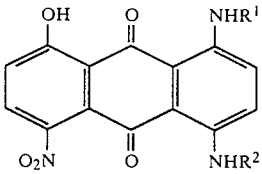
-continued
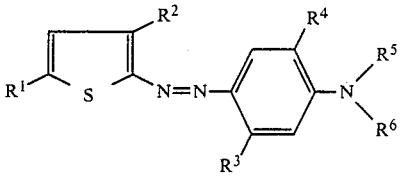
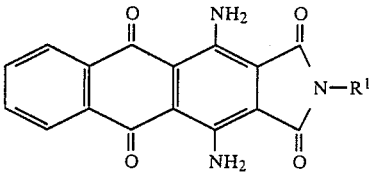
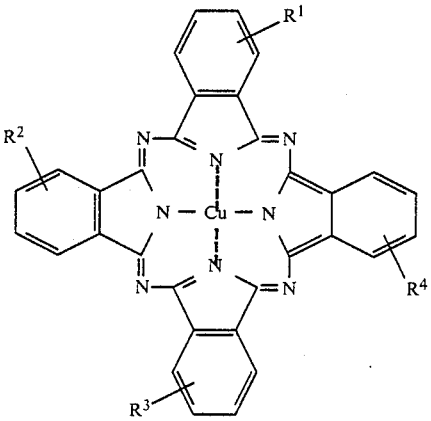
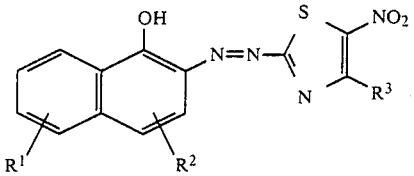
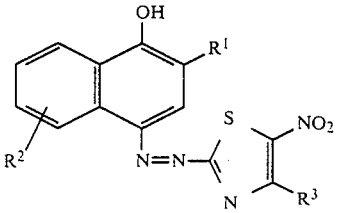
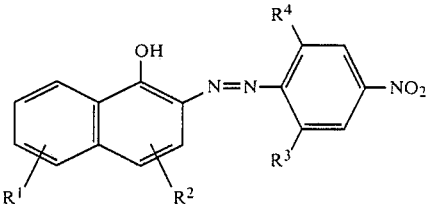

-continued

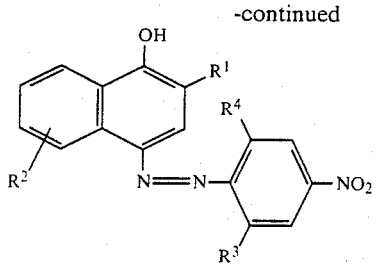

wherein $R^1$ to $R^6$ each represents hydrogen or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an aryloxyalkyl group, an amino group, a substituted amino group, an alkylthio group or an arylthio group. The alkyl moiety and the aryl moiety in the above described substituents may be further substituted with a halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, an alkylsulfonylamino group, an arylsulfonylamino group or a ureido group. It is preferred that the number of the carbon atoms of substituent represented by $R^1$, $R^2$, $R^3$, $R^4$, $R^5$ or $R^6$ is up to 16 and the total number of the carbon atoms of substituents represented by $R^1$ to $R^6$ is up to 25.

Examples of the hydrophilic groups include a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group, an alkoxyalkoxy group, etc.

In the present invention, those in which the hydrophilic property thereof is increased by dissociation of a proton under a basic condition (pKa<12) are particularly preferred. Examples of these groups include a phenolic hydroxy group, a carboxy group, a suflo group, a phosphoric acid group, an imido group, a hydroxamic acid group, a (substituted) sulfamoyl group, a (substituted) sulfamoylamino group, etc.

Characteristics required for the image forming dye are as follows.

1. It has a hue suitable for color reproduction.
2. It has a large molecular extinction coefficient.
3. It is fast to light and heat and stable for the dye releasing activator and other additive included in the system; and
4. It is easily synthesized.

Specific examples of preferred image forming dyes which satisfy the above described requirements are described in the following.

Yellow:

-continued

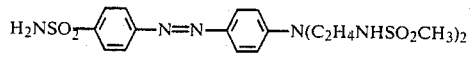

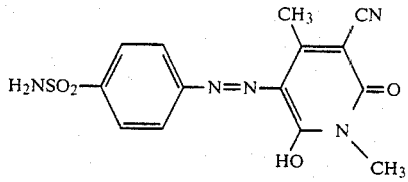

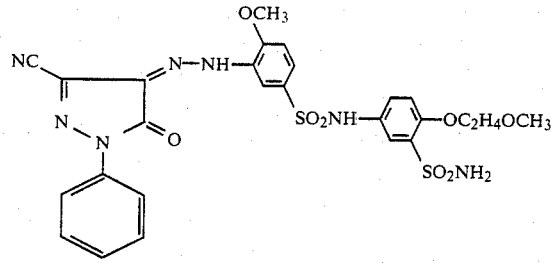

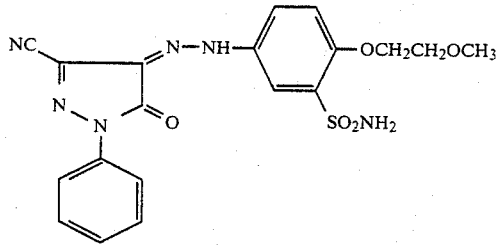

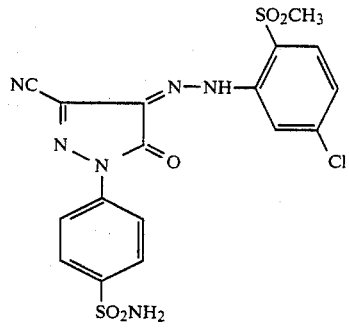

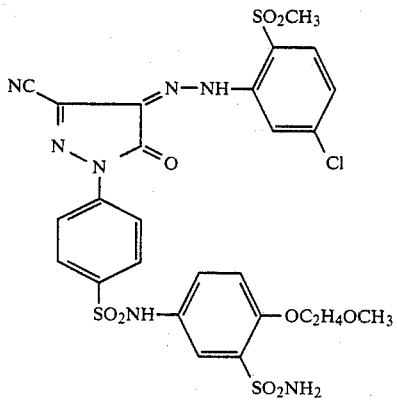

-continued
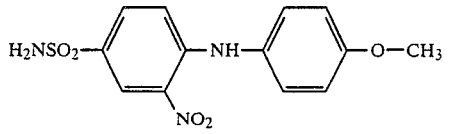
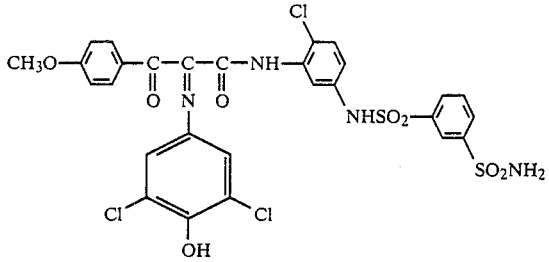
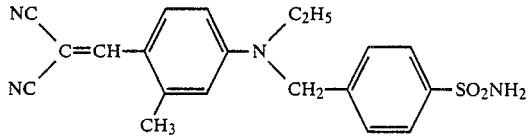
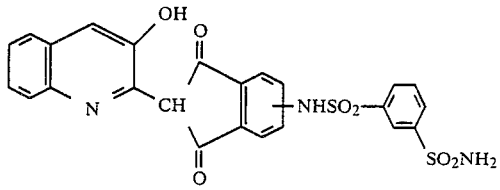
Magenta:
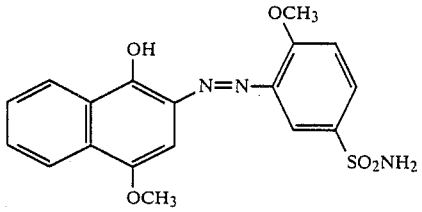
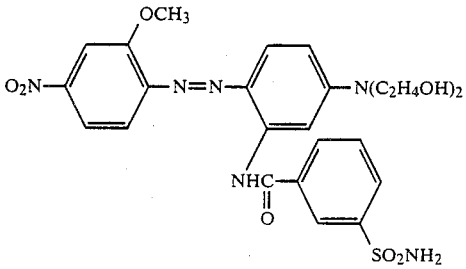
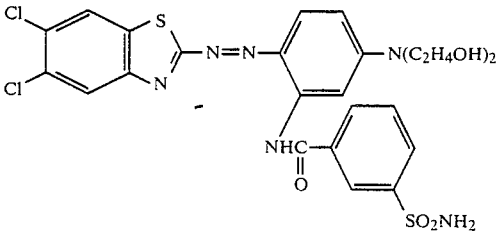
-continued
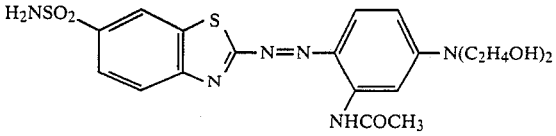
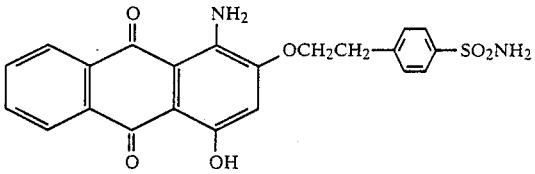
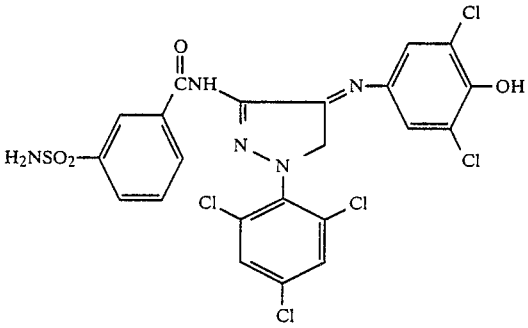
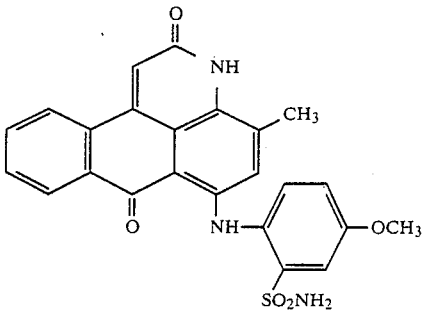
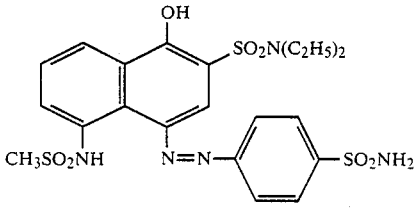
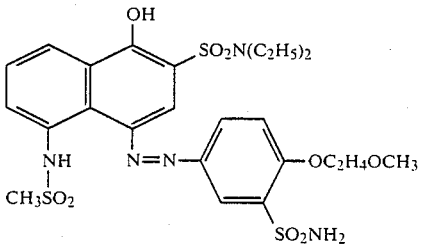

-continued
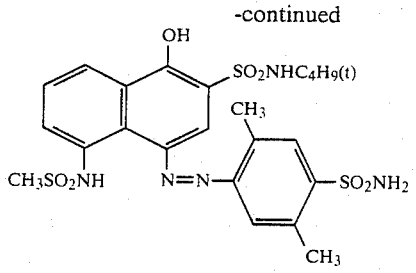
Cyan:
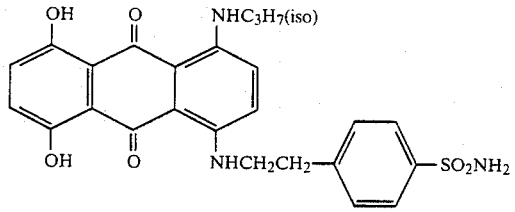
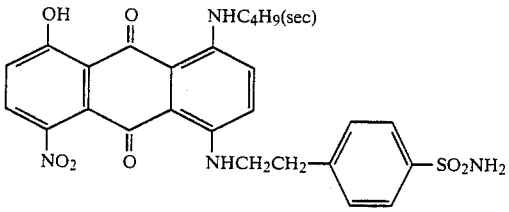
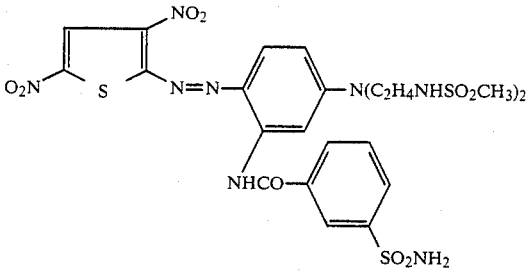
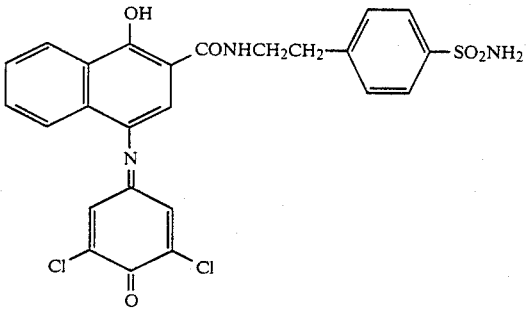
-continued
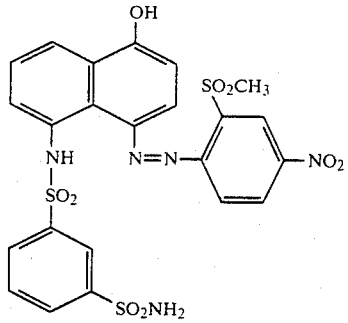
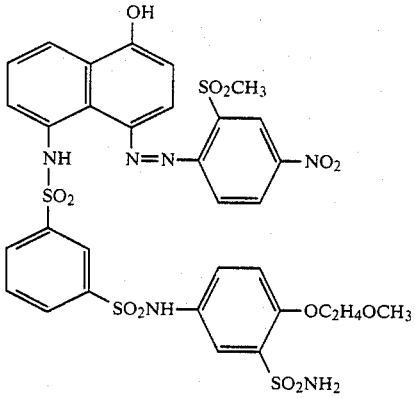
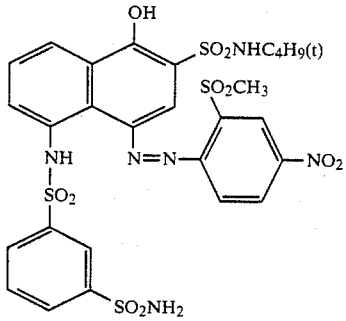
wherein the end group $-SO_2NH_2$ in these dyes represents a group necessary to bond to the reducing group R.
In the following, specific examples of the particularly preferred dye releasing compounds are described.
(1)
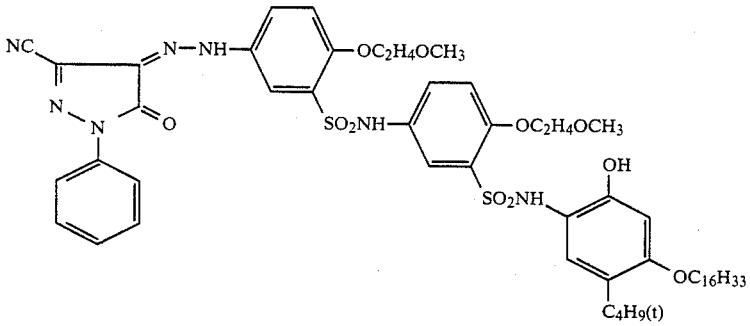

-continued
(2)
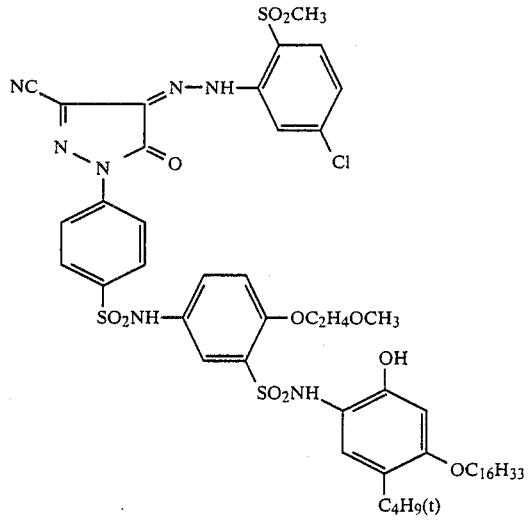
(3)
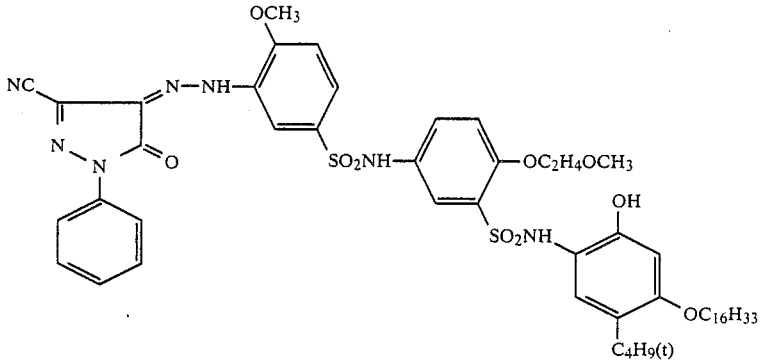
(4)
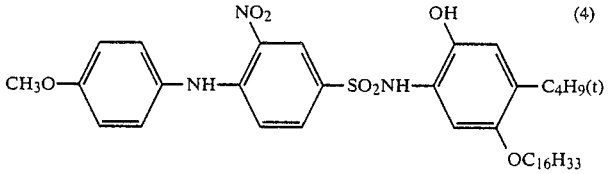
(5)
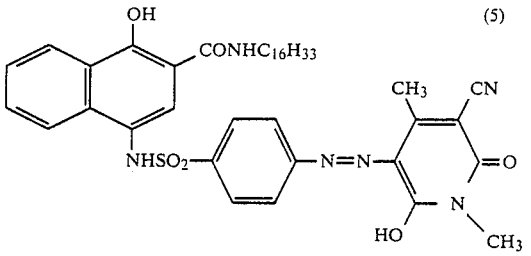
(6)
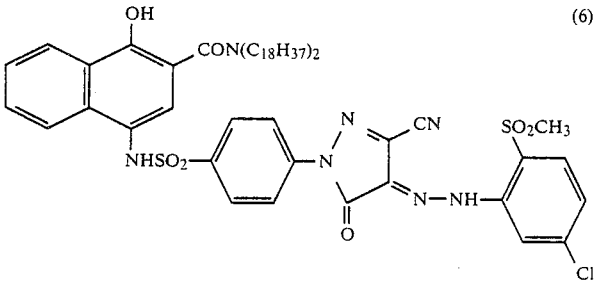
(7)
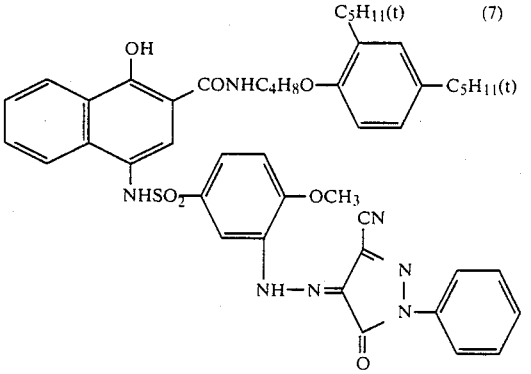

-continued
(8)
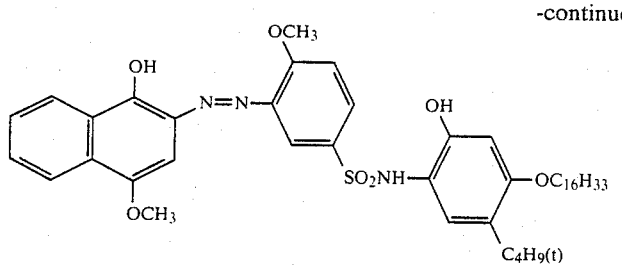
(9)
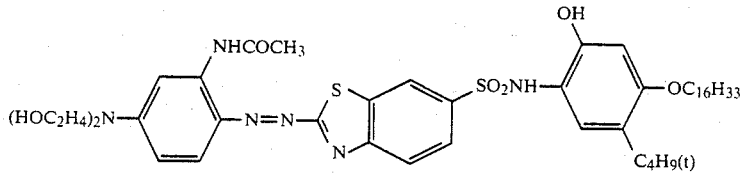
(10)
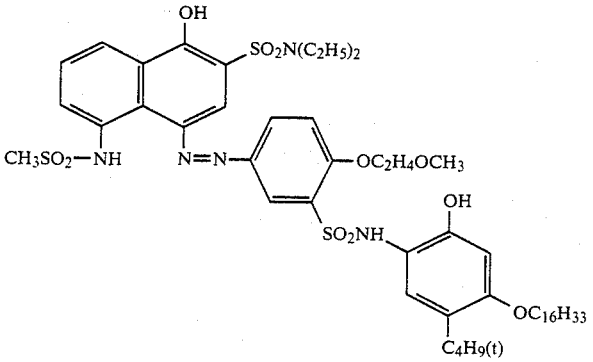
(11)
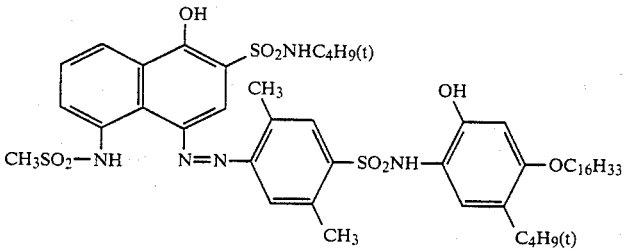
(12)
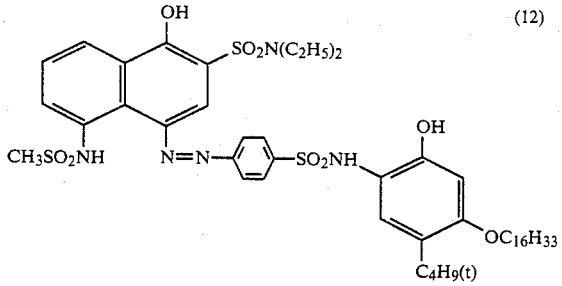
(13)
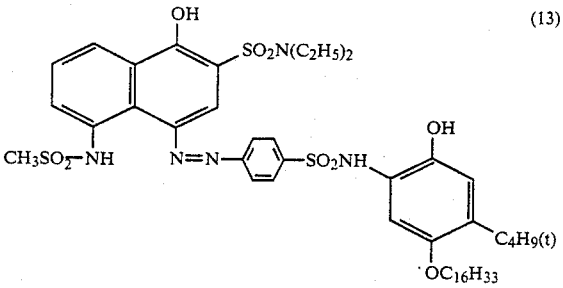
(14)
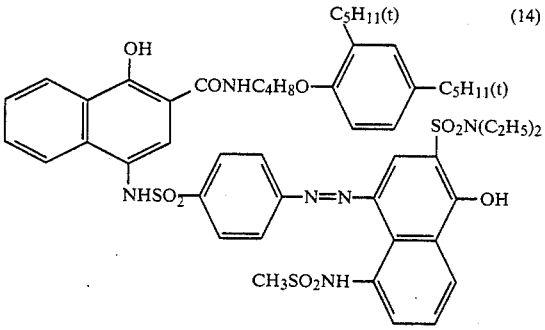
(15)
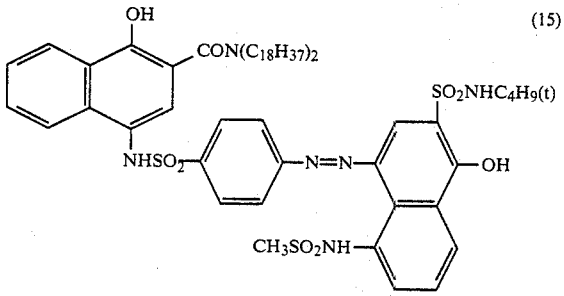

-continued
(16)
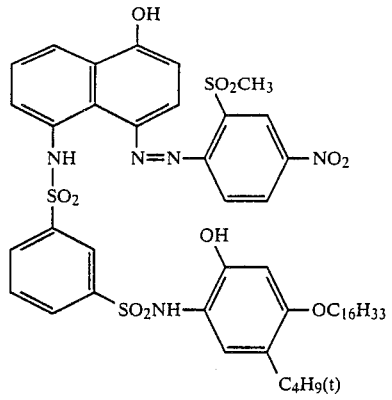
(17)
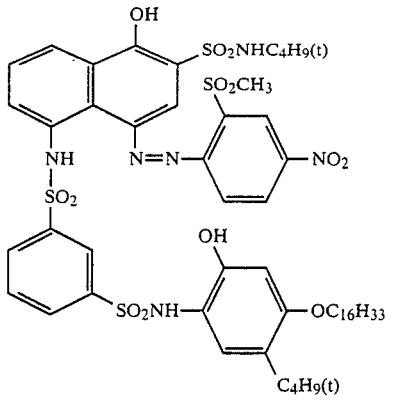
(18)
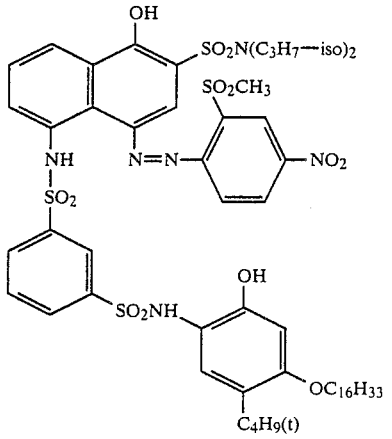
(19)
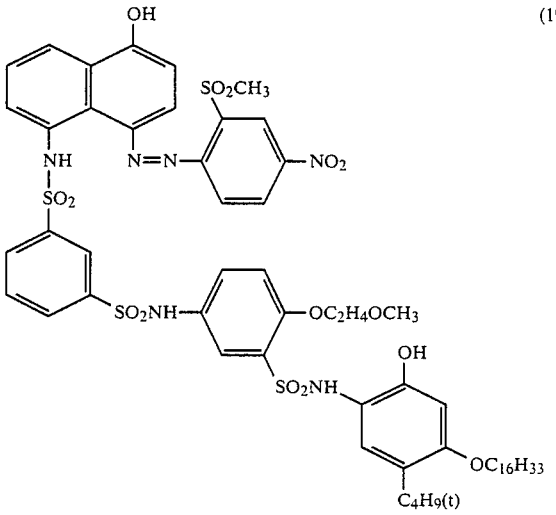
(20)
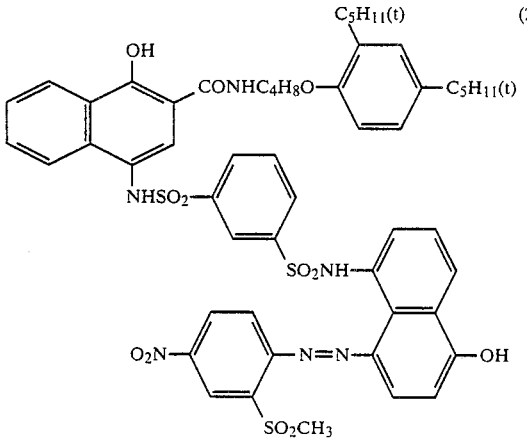
(21)
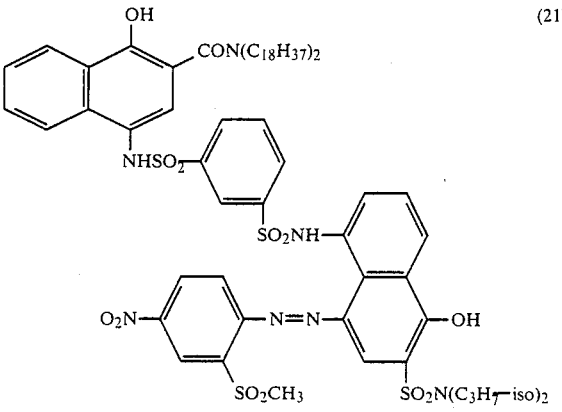
(22)
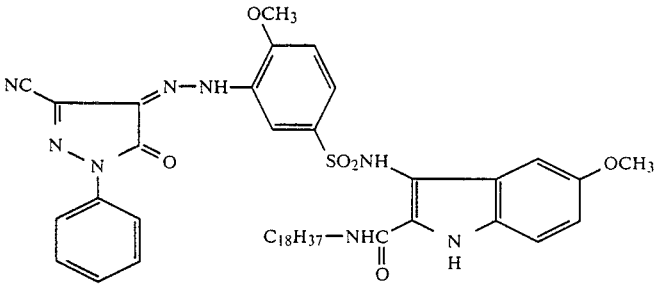

-continued
(23)
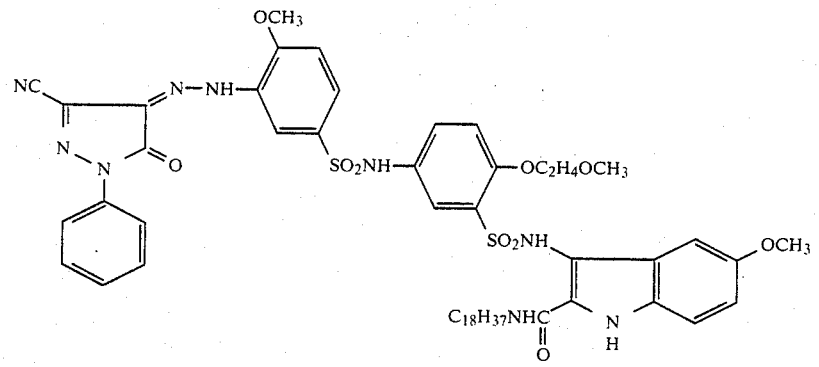
(24)
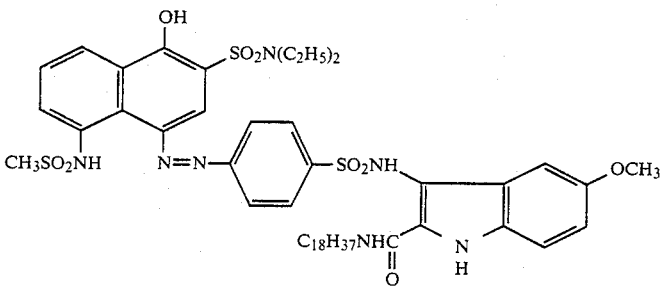
(25)
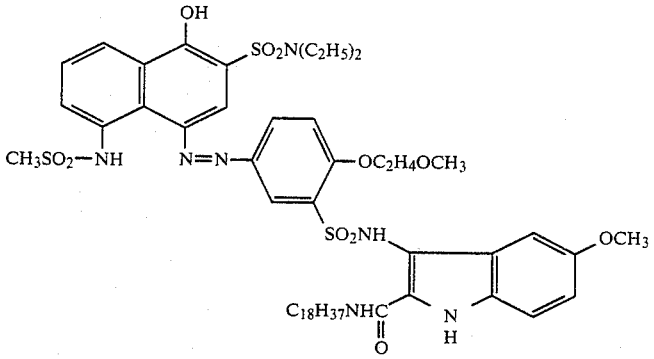
(26)
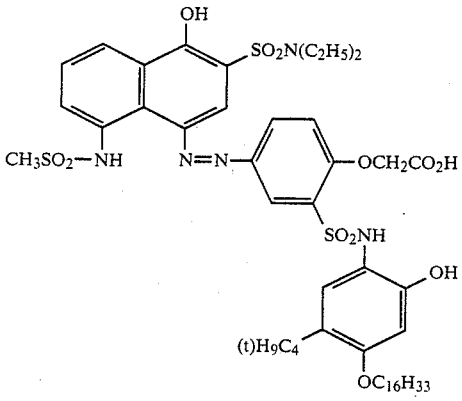

-continued
(27)
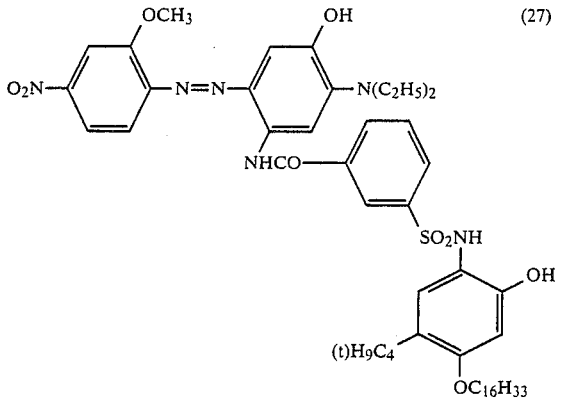
(28)
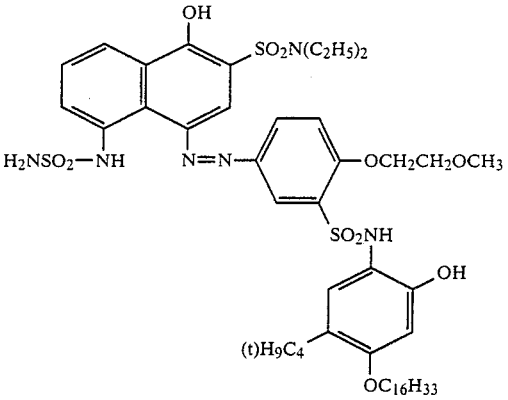
(29)
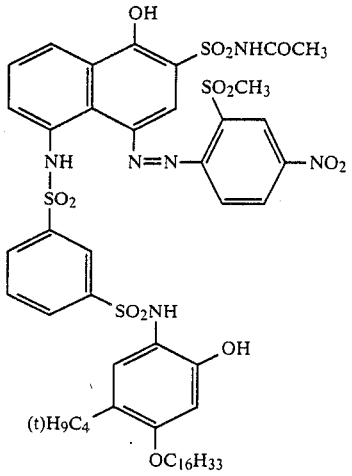
(30)
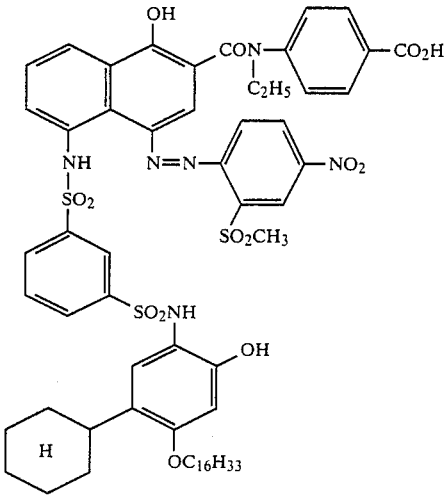
(31)
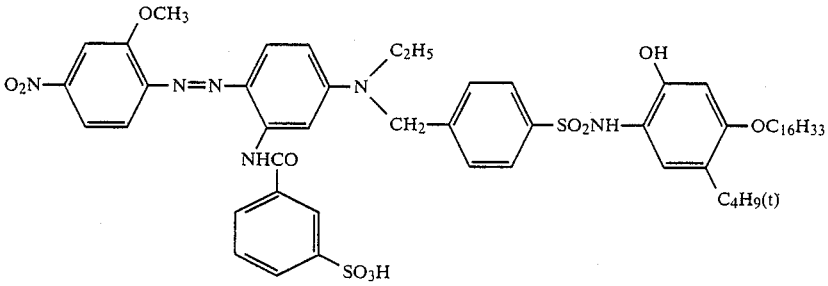
(32)
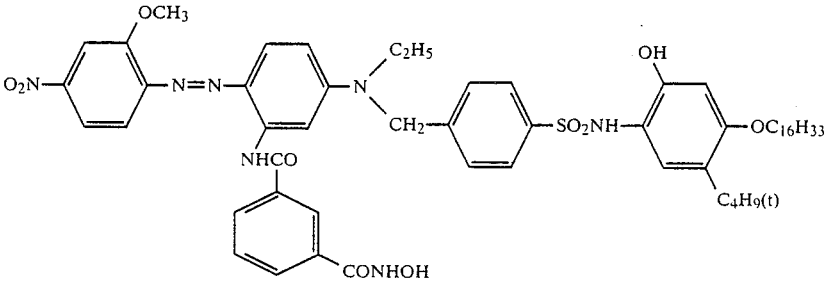

-continued
(33)
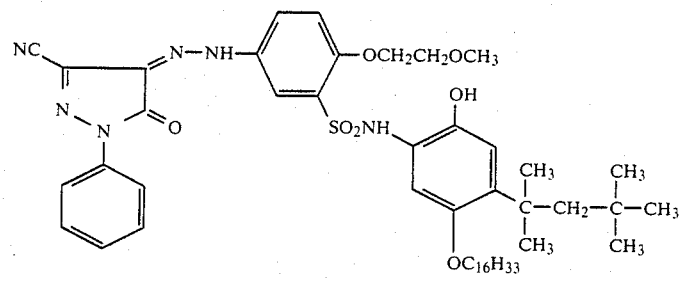
(34)
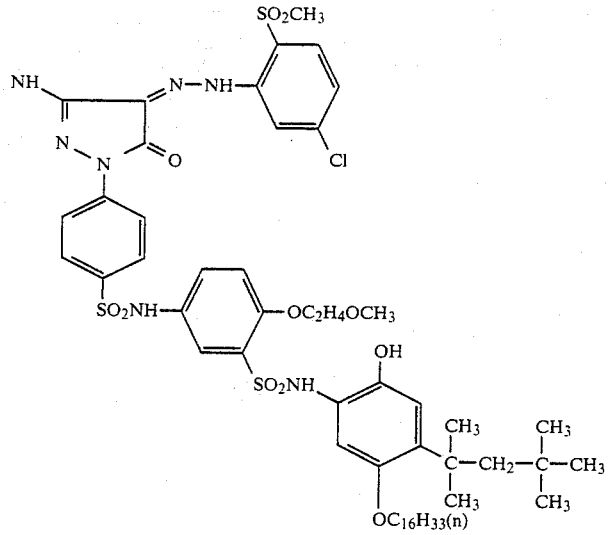
(35)
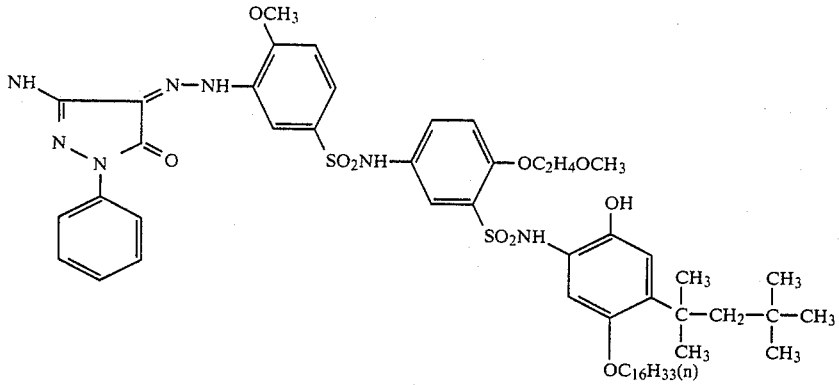
(36)
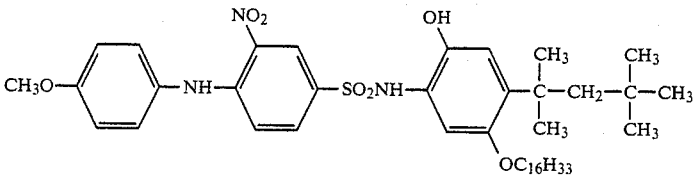
(37)
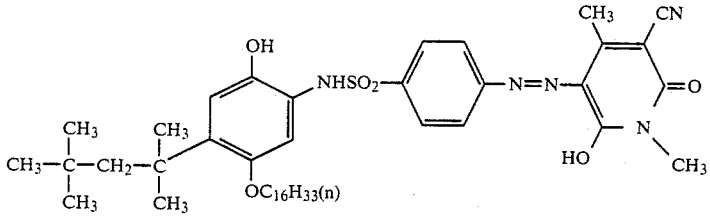

-continued
(38)
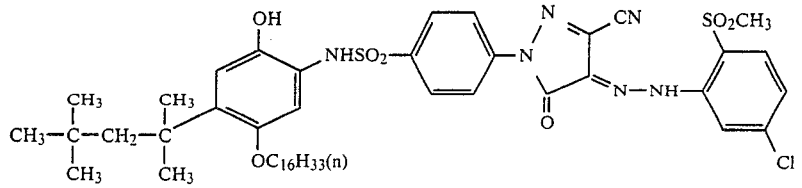
(39)
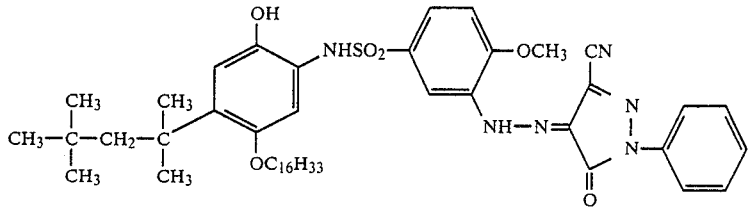
(40)
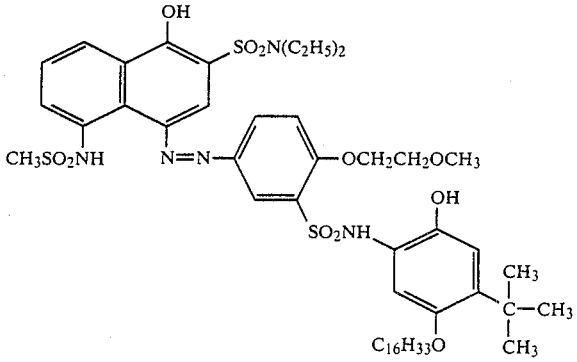
(41)
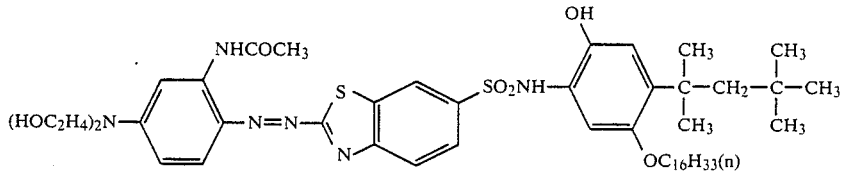
(42)
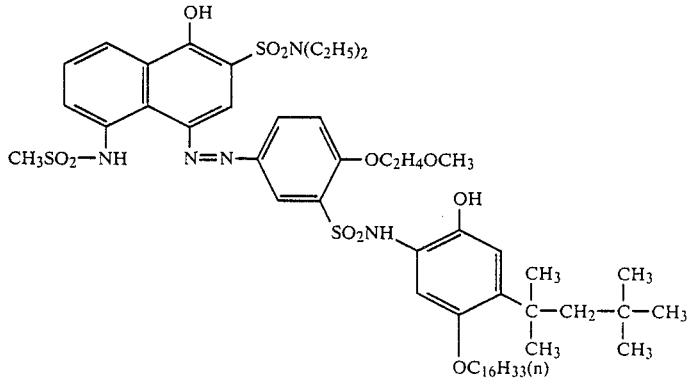
(43)
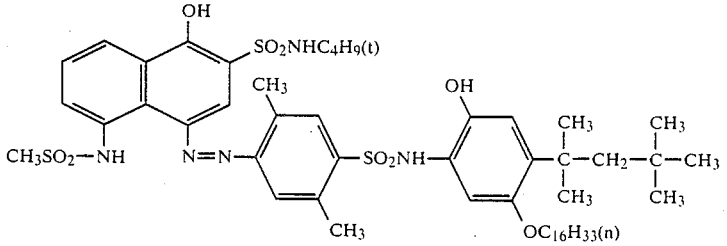

-continued
(44)
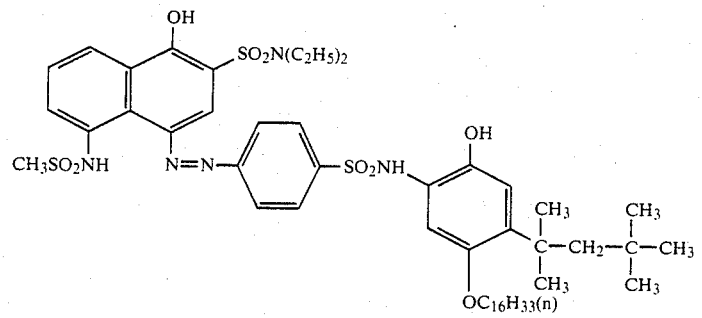
(45)
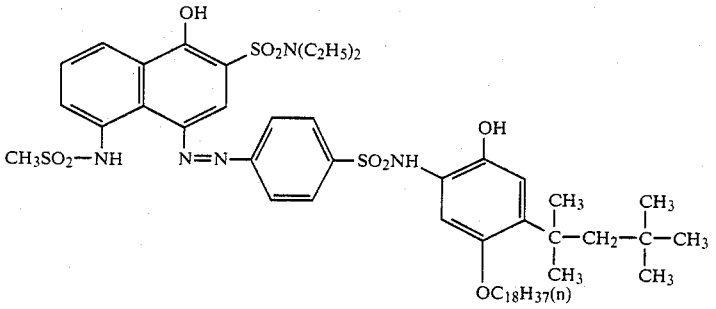
(46)
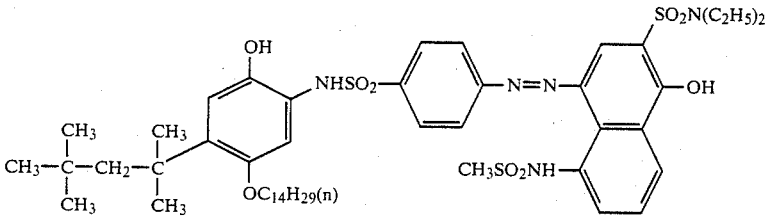
(47)
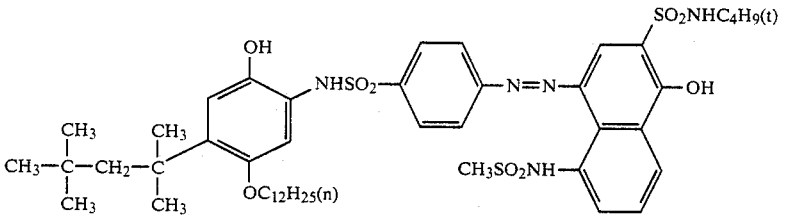
(48)
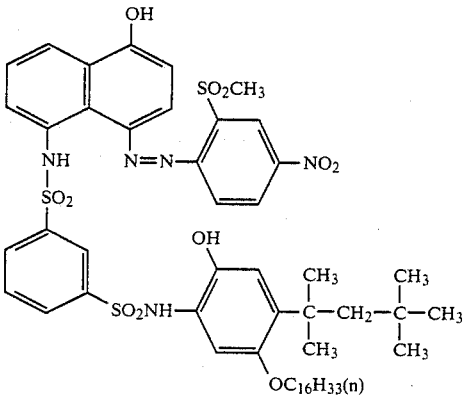
(49)
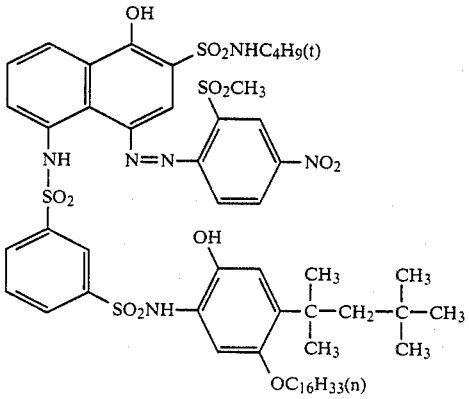

-continued
(50)
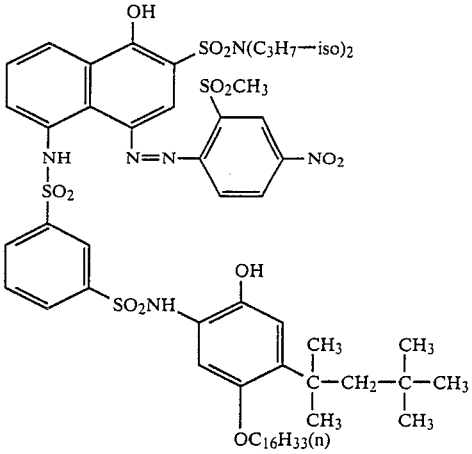
(51)
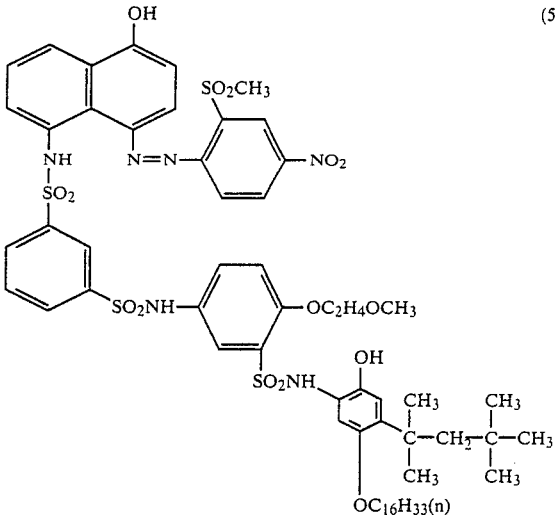
(52)
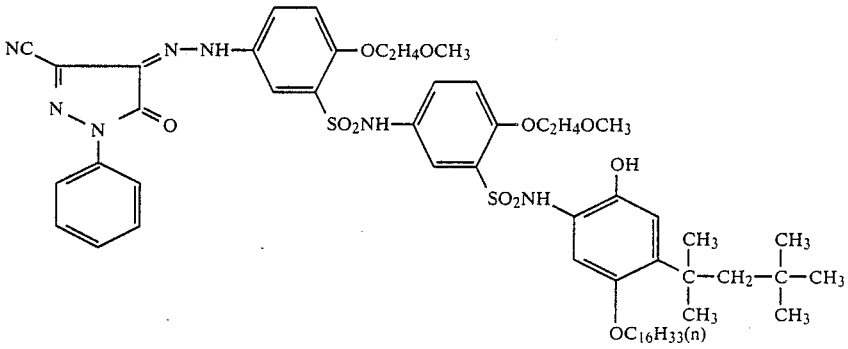
(53)
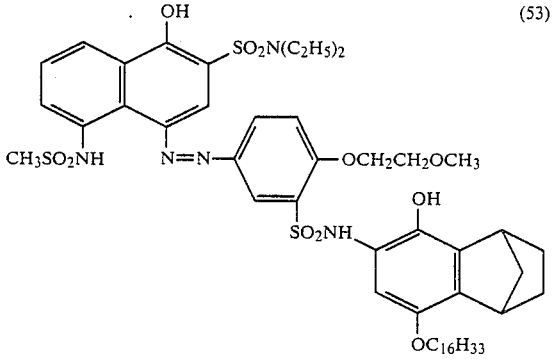
(54)
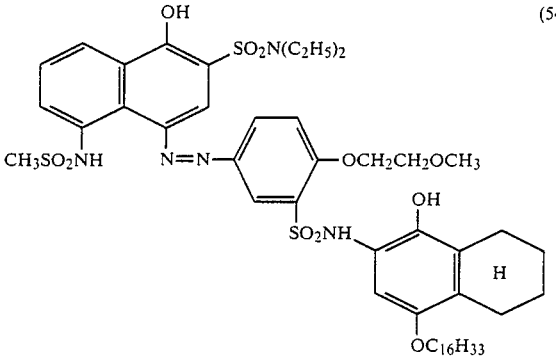
(55)
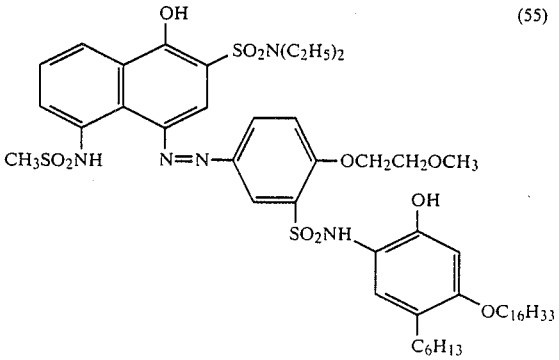
(56)
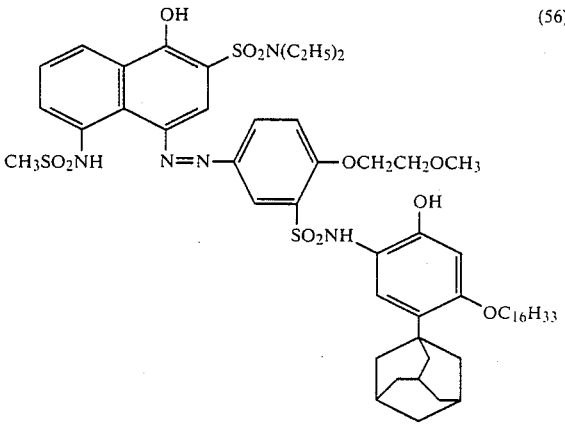

-continued
(57)
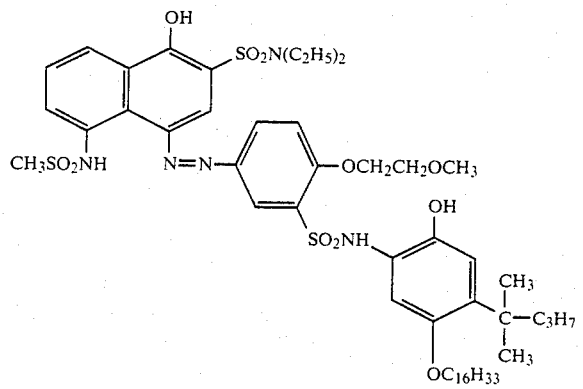
(58)
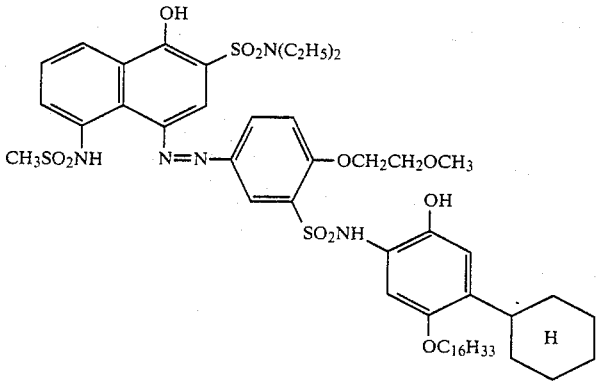
(59)
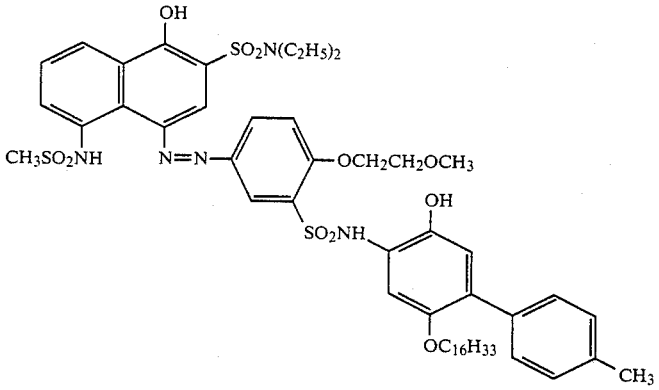
(60)
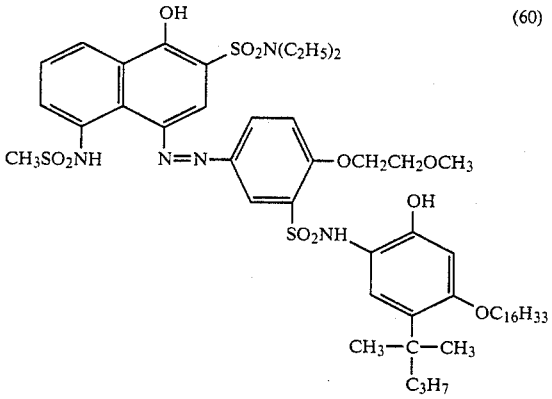
(61)
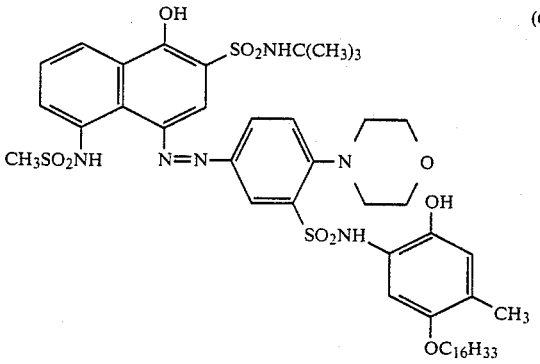

-continued (62)

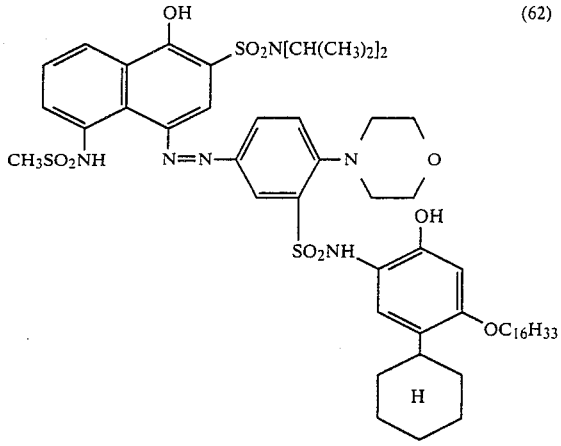

(63)

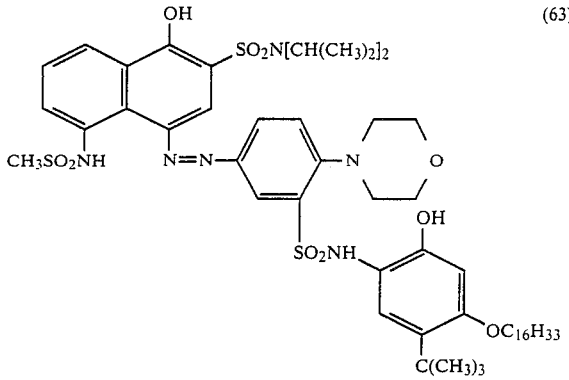

(64)

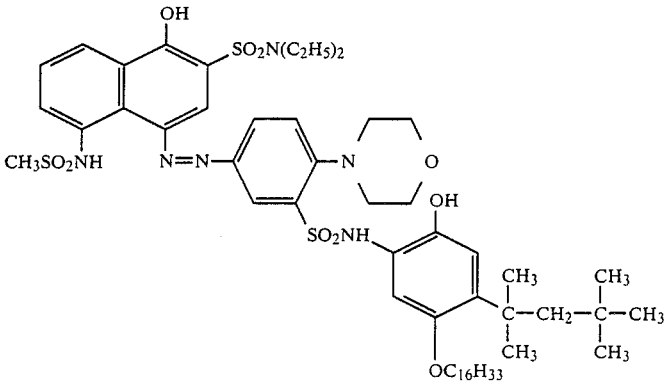

(65)

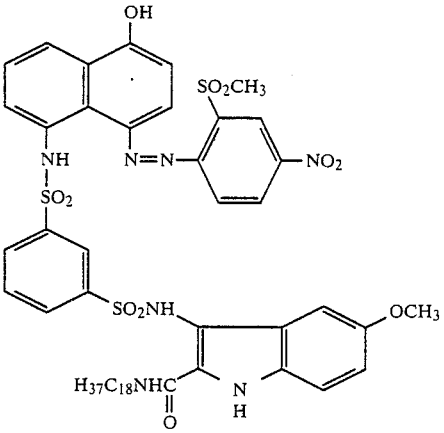

(66)

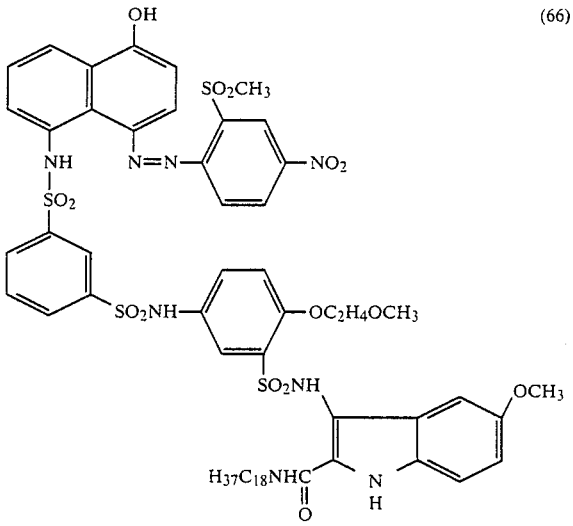

As the dye releasing compounds used in the present invention, the compounds as described, for example, in U.S. Pat. No. 4,055,428, Japanese Patent Application (OPI) Nos. 12642/81, 16130/81, 16131/81, 630/82 and 4043/82, U.S. Pat. Nos. 3,928,312 and 4,076,529, U.S. Published Patent Application B 351,673, U.S. Pat. Nos. 4,135,929 and 4,198,235, Japanese Patent Application (OPI) No. 46730/78, U.S. Pat. Nos. 4,273,855, 4,149,892, 4,142,891 and 4,258,120 (incorporated herein by reference to disclose dye releasing compounds), etc., are also effective in addition to the above described specific examples.

Further, the dye releasing compounds which release a yellow dye as described, for example, in U.S. Pat. Nos. 4,013,633, 4,156,609, 4,148,641, 4,165,987, 4,148,643, 4,183,755, 4,246,414, 4,268,625 and 4,245,028 (incorporated herein by reference to disclose dye releasing compounds), Japanese Patent Application (OPI) Nos. 71072/81, 25737/81, 138744/80, 134849/80, 106727/77, 114930/76, etc., can be effectively used in the present invention.

The dye releasing compounds which release a magenta dye as described, for example, in U.S. Pat. Nos. 3,954,476, 3,932,380, 3,931,144, 3,932,381, 4,268,624 and 4,255,509 (incorporated herein by reference to disclose dye releasing compounds), Japanese Patent Application (OPI) Nos. 73057/81, 71060/81, 134850/80, 40402/80, 36804/80, 23628/78, 106727/77, 33142/80 and 53329/80, etc., can be effectively used in the present invention.

The dye releasing compounds which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625 (incorporated herein by reference to disclose dye releasing compounds), Japanese Patent Application (OPI) Nos. 71061/81, 47823/78, 8827/77 and 143323/78, etc., can be effectively used in the present invention.

Processes for synthesizing the dye releasing compounds are described below.

Generally, the dye releasing compounds used in the present invention are obtained by condensing an amino group included in the reducing group R with a chlorosulfonyl group included in the image forming dye portion D.

The amino group of the reducing group R can be introduced by reduction of a nitro group, a nitroso group or an azo group or by ring-opening reaction of benzoxazoles and may be used as a free base or may be used as a salt of an inorganic acid. Further, the chlorosulfonyl group of the image forming dye portion D is obtained by converting the corresponding sulfonic acid or salts thereof using a chlorinating agent such as phosphorus oxychloride, phosphorus pentachloride or thionyl chloride, etc., according to a conventional method.

The condensation reaction of the reducing group R with the image forming dye portion D can be generally carried out in an aprotic polar solvent such as dimethylformamide, dimethylacetamide, dimethyl sulfoxide, N-methylpyrrolidone or acetonitrile, etc., in a presence of an organic base such as pyridine, picoline, lutidine, triethylamine or diisopropylethylamine, etc., at 0° to 50° C. by which the desired dye releasing compound can usually be obtained in a high yield. Synthesis examples of the dye releasing compounds are set forth below.

SYNTHESIS EXAMPLE 1

Synthesis of Dye Releasing Compound (1)

(a) A mixture of 306 g of 2,4-dihydroxyacetophenone, 164 g of hydroxyamine hydrochloride, 328 g of sodium acetate, 1,000 ml of ethanol and 500 ml of water was refluxed by heating for 4 hours. The reaction solution was poured into 10 l of water to precipitate crystals and these crystals were collected by filtration. 314 g of 2,4-dihydroxyacetophenoneoxime was obtained.

30 g of the thus-obtained oxime was dissolved in 400 ml of acetic acid. While the acetic acid solution was heated at 120° C. with stirring, a hydrogen chloride gas was blown through the acetic acid solution for 2 hours. The acetic acid solution was cooled to precipitate crystals, and the crystals were collected by filtration and washed with water. 17 g of 6-hydroxy-2-methylbenzoxazole was obtained.

(b) A mixture of 18.0 g of 6-hydroxy-2-methylbenzoxazole, 36.6 g of 1-bromohexadecane, 24.0 g of potassium carbonate and 120 ml of N,N-dimethylformamide was stirred at 90° C. for 4.5 hours. The reaction solution was filtered to remove solids and the filtrate was poured into 500 ml of methanol to precipitate crystals. These crystals were collected by filtration. 45.0 g of 6-hexadecyloxy-2-methylbenzoxazole was obtained.

(c) A mixture of 111 g of 6-hexadecyloxy-2-methylbenzoxazole, 1,300 ml of ethanol, 110 ml of 33% hydrochloric acid and 550 ml of water was stirred at 55°–60° C. for 4 hours. The reaction solution was cooled to precipitate crystals, and the crystals were collected by filtration. 113 g of 2-acetylamino-5-hexadecyloxyphenol was obtained.

(d) A mixture of 30.0 g of 2-acetylamino-5-hexadecyloxyphenol, 20.0 g of Amberlyst 15 (produced by Rohm & Haas Co., U.S.A.) and 300 ml of toluene was stirred while heating at 80°–90° C., during which isobutene was bubbled therethrough for 5 hours. The reaction solution was filtered to remove solids and the filtrate was condensed. On adding 350 ml of n-hexane to the residue, crystals precipitated. The crystals were collected by filtration. 23.5 g of 2-acetylamino-4-tert-butyl-5-hexadecyloxyphenol was obtained.

(e) A mixture of 23.0 g of 2-acetylamino-4-tert-butyl-5-hexadecyloxyphenol, 120 ml of ethanol and 96 ml of 35% hydrochloric acid was refluxed with stirring for 5 hours. The reaction solution was cooled to precipitate crystals. The crystals were collected by filtration. 23.2 g of 2-amino-4-tert-butyl-5-hexadecyloxyphenol hydrochloride was obtained.

(f) A mixture of 4.4 g of 2-amino-4-tert-butyl-5-hexadecyloxyphenol hydrochloride and 3.1 g of 2-(2-methoxyethoxy)-5-nitrobenzenesulfonyl chloride was dissolved in 12 ml of N,N-dimethylacetamide, to which 2.5 ml of pyridine was added. The resulting mixture was then stirred at 25° C. for 1 hour. On pouring the reaction solution into diluted hydrochloric acid, oily products precipitated. On adding 30 ml of methanol, the oily product crystallized. These crystals were collected by filtration. Yield: 4.5 g.

(g) 10 g of the compound obtained in above (f) was dissolved in 60 ml of ethanol, and about 0.5 g of 10% palladium-carbon catalyst was added. Thereafter, hydrogen was introduced at 55 kg/cm$^2$ and the above-prepared mixture was stirred at 60° C. for 6 hours. Then the catalyst was removed while the mixture was still hot, and the mixture was allowed to cool whereupon crystals precipitated. The crystals were collected by filtration. Thus, 7.5 g of 2-[5-amino-2-(2-methoxyethoxy)-benzenesulfonylamino]-4-tert-butyl-5-hexadecyloxyphenol was obtained.

(h) To a solution prepared by dissolving 8.0 g of sodium hydroxide in 200 ml of water were added 49.4 g of 5-amino-2-(2-methoxyethoxy)benzenesulfonic acid and 50 ml of an aqueous solution of 13.8 g of sodium nitrite. Separately, a mixture of 60 ml of concentrated hydrochloric acid and 400 ml of water was prepared, to which was dropwise added at 5° C. or below the above-prepared solution. The resulting mixture was then stirred at 5° C. or below for 30 minutes to complete the reaction.

Separately, 16.0 g of sodium hydroxide, 200 ml of water, 33.0 g of sodium acetate and 220 ml of methanol were mixed to prepare a solution and 37.0 g of 3-cyano-1-phenyl-5-pyrazolone was added thereto. To the resulting solution the above-prepared diazo solution was dropwise added at 10° C. or below. After the dropwise addition was completed, the reaction mixture was stirred at 10° C. or below for 30 minutes and then at room temperature for 1 hour. The crystals precipitated were collected by filtration, washed with 200 ml of acetone and dried by air. Thus, 52 g of 3-cyano-4-[4-(2-methoxyethoxy)-5-sulfophenylazo]-1-phenyl-5-pyrazolone was obtained.

(i) To a mixture of 51.0 g of the 3-cyano-4-[4-(2-methoxyethoxy)-5-sulfophenylazo]-1-phenyl-5-pyrazolone, 250 ml of acetone and 50 ml of phosphorus oxychloride was dropwise added 50 ml of N,N-dimethylacetamide at 50° C. or below. After the addition, the reaction mixture was stirred for about 1 hour and gradually poured into 1.0 l of ice water. The crystals precipitated were collected by filtration, washed with 100 ml of acetonitrile and dried by air. Thus, 46.7 g of 3-cyano-4-[4-(2-methoxyethoxy)-5-chlorosulfonylphenylazo]-1-phenyl-5-pyrazolone was obtained.

(j) To a solution prepared by dissolving 6.3 g of 2-[5-amino-2-(2-methoxyethoxy)benzenesulfonylamino]-4-tert-butyl-5-hexadecyloxyphenol in 30 ml of N,N-dimethylacetamide were added 4.6 g of 3-cyano-4-[4-(2-methoxyethoxy)-5-chlorosulfonylphenylazo]-1-phenyl-5-pyrazolone and furthermore 5 ml of pyridine. After stirring at room temperature for 1 hour, the reaction solution was poured into diluted hydrochloric acid. Precipitated crystals were collected by filtration and recrystallized from a solvent mixture of N,N-dimethylacetamide and methanol to obtain 7.5 g of Dye Releasing Compound (1). m.p.: 189° to 191° C.

SYNTHESIS EXAMPLE 2

Synthesis of Dye Releasing Compound (2)

To a solution prepared by dissolving 6.3 g of 2-[5-amino-2-(2-methoxyethoxy)benzenesulfonylamino]-4-tert-butyl-5-hexadecyloxyphenol in 30 ml of N,N-dimethylacetamide were added 5.0 g of 3-cyano-4-(5-chloro-2-methylsulfonylphenylazo)-1-(4-chlorosulfonylphenyl)-5-pyrazolone and furthermore 5 ml of pyridine. After stirring at room temperature for 1 hour, the reaction solution was poured in diluted hydrochloric acid. Precipitated crystals were collected by filtration and recrystallized from acetonitrile to obtain 8.4 g of Dye Releasing Compound (2). m.p.: 144°–149° C.

SYNTHESIS EXAMPLE 3

Synthesis of Dye Releasing Compound (10)

In 20 ml of N,N-dimethylacetamide were dissolved 4.4 g of 2-amino-4-tert-butyl-5-hexadecyloxyphenol hydrochloride and 6.5 g of 4-[3-chlorosulfonyl-4-(2-methoxyethoxy)phenylazo]-2-(N,N-diethylsulfamoyl)-5-methylsulfonylamino-1-naphthol, and 4.2 ml of pyridine was added thereto. After stirring at 25° C. for 1 hour, the reaction solution was poured into diluted hydrochloric acid. The solids thus precipitated were collected by filtration and purified by silica gel column chromatography (eluted by a chloroform-ethyl acetate (2:1) mixed solvent). Yield: 5.2 g; m.p.: 72° to 73° C.

SYNTHESIS EXAMPLE 4

Synthesis of Dye Releasing Compound (16)

In 100 ml of N,N-dimethylacetamide was dissolved 11.6 g of 2-amino-4-tert-butyl-5-hexadecyloxyphenol hydrochloride, and 12 ml of pyridine was added thereto. Then, 18 g of 5-(3-chlorosulfonylbenzenesulfonylamino)-4-(2-methylsulfonyl-4-nitrophenylazo)-1-naphthol was added. The resulting mixture was stirred for 1 hour and poured into 500 ml of ice water. The precipitates were collected and recrystallized from an isopropyl alcohol-acetonitrile (1:1) mixed solvent. 6.8 g of Dye Releasing Compound (16) was obtained. m.p.: 130°–132° C.

SYNTHESIS EXAMPLE 5

Synthesis of Dye Releasing Compound (19)

In 100 ml of N,N-dimethylacetamide were dissolved 31.5 g of 2-[5-amino-2-(2-methoxyethoxy)benzenesulfonylamino]-4-tert-butyl-5-hexadecyloxyphenol and 39.1 g of 5-(3-chlorosulfonylbenzenesulfonylamino)-4-(2-methylsulfonyl-4-nitrophenylazo)-1-naphthol, and 21 ml of pyridine was added thereto. After the mixture was stirred for 80 minutes, 250 ml of methanol and 100 ml of water were added. A resinous product precipitated and solidified in a short time, and it was then separated by filtration. The crude product was recrystallized from a toluene-methanol-water (16:4:3) mixed solvent, thus 41.5 g of Dye Releasing Compound (19) was obtained. m.p.: 183°–184° C.

SYNTHESIS EXAMPLE 6

Synthesis of Dye Releasing Compound (40)

(a) 83 g of tert-butyl hydroquinone was dissolved in 400 ml of acetic acid and the solution was heated at 80° to 90° C. to which boron trifluoride was introduced for about 3 hours. After the completion of the reaction, the reaction mixture was poured into 1 liter of ice water and the viscous solid thus precipitated was collected by filtration. The solid was dissolved in 600 ml of a 2N sodium hydroxide solution and the insoluble material was removed by filtration. The filtrate was acidified with diluted hydrochloric acid, the crystals thus precipitated were collected by filtration, washed with water and recrystallized from water-containing methanol. Thus, 68 g of 2,5-dihydroxy-4-tert-butyl-acetophenone was obtained.

(b) 21 g of the above obtained ketone was dissolved by heating together with 70 ml of ethanol and 24 g of sodium acetate. To the solution was added with stirring a solution containing 12 g of hydroxylamine hydrochloride dissolved in 70 ml of water and the mixture was refluxed for about 1 hour. After the completion of the reaction, the reaction mixture was poured into 500 ml of ice water, the crystals of the oxime thus precipitated were collected by filtration and recrystallized from a solvent mixture of benzene and hexane. Yield: 17 g (76%).

(c) 14 g of the oxime was dissolved in 100 ml of acetic acid, to the solution a dry hydrogen chloride gas was introduced with heating and refluxed for 1.5 hours. After the completion of the reaction, the reaction mixture was poured into 500 ml of ice water, the crystals thus precipitated were collected by filtration and washed with water. Thus, 9 g of 6-tert-butyl-5-hydroxy-2-methylbenzoxazole was obtained.

(d) 6.9 g of the benzoxazole derivative obtained in Step (c) was dissolved in 50 ml of dimethylformamide and the solution was stirred at 80° to 90° C. for 6 hours together with 8 g of anhydrous potassium carbonate and 11 g of hexadecyl bromide. After the completion of the reaction, the insoluble material was removed by filtration. To the filtrate was added 150 ml of methanol and the mixture was cooled with ice to precipitate crystals. The crystals were collected by filtration, thus obtained 8.8 g of 6-tert-butyl-5-hexadecyloxy-2-methylbenzoxazole.

(e) 7.3 g of the benzoxazole compound obtained in Step (d) was refluxed for 3 hours together with 30 ml of ethanol and 20 ml of concentrated hydrochloric acid. After the completion of the reaction, the reaction mixture was allowed to stand and cool. The crystals thus precipitated were collected by filtration, washed with water and then washed with acetone. Thus, 6.9 g of 2-amino-5-tert-butyl-4-hexadecyloxyphenol hydrochloride was obtained.

(f) 6 g of the hydrochloride obtained in Step (e) and 8.8 g of sulfonyl chloride of dye having the structure shown below were dissolved in 50 ml of dimethylacetamide, to the solution was added 4 ml of pyridine and the mixture was stirred at room temperature for 1 hour. After the completion of the reaction, the reaction mixture was poured into diluted hydrochloric acid, the crystals thus precipitated were collected by filtration and washed with water. After drying, the product was purified by silica gel chromatography to obtain 2.2 g of Dye Releasing Compound (40) as a substantially pure component. m.p.: 71°–75° C.

Sulfonyl Chloride of Dye:

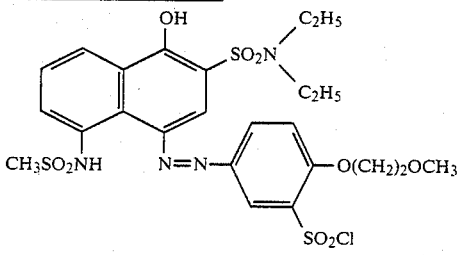

SYNTHESIS EXAMPLE 7

Synthesis of Dye Releasing Compound (42)

In the Step (d) of Synthesis Example 6 described above, O-hexadecylation was carried out using 6-tert-octyl-5-hydroxy-2-methylbenzoxazole in place of 6-tert-butyl-5-hydroxy-2-methylbenzoxazole. Then the same procedures as described in Step (e) and Step (f) of Synthesis Example 6 were repeated to obtain Dye Releasing Compound (42). m.p.: 60°–64° C.

The dye releasing redox compound which releases a diffusible dye according to the present invention can be used in an amount of a fixed range. Generally, a suitable range is about 0.01 mol to about 4 mols of the dye releasing compound per mol of the silver. A particularly suitable amount in the present invention is in a range of about 0.05 to about 1 mol per mol of the silver.

In the present invention, if necessary, a reducing agent may be used. The reducing agent in this case is the so-called auxiliary developing agent, which is oxidized by the silver salt oxidizing agent to form its oxidized product having an ability to oxidize the reducing group R in the dye releasing compound.

Examples of useful auxiliary developing agents include hydroquinone, alkyl substituted hydroquinones such as tertiary butyl hydroquinone or 2,5-dimethylhydroquinone, catechols, pyrogallols, halogen substituted hydroquinones such as chlorohydroquinone or dichlorohydroquinone, alkoxy substituted hydroquinones such as methoxyhydroquinone, and polyhydroxybenzene derivatives such as methyl hydroxynaphthalene, etc. Further, there are methyl gallate, ascorbic acid, ascorbic acid derivatives, hydroxylamines such as N,N-di(2-ethoxyethyl)hydroxylamine, etc., pyrazolidones such as 1-phenyl-3-pyrazolidone or 4-methyl-4-hydroxymethyl-1-phenyl-3-pyrazolidone, etc., reductones and hydroxy tetronic acids.

The auxiliary developing agent can be used in an amount of a fixed range. A suitable range is 0.01 time by mol to 20 times by mol based on the organic silver salt oxidizing agent. A particularly suitable range is 0.1 time by mol to 4 times by mol.

Examples of silver halide include silver chloride, silver chlorobromide, silver chloroiodide, silver bromide, silver iodobromide, silver chloroiodobromide and silver iodide, etc.

Particularly preferred examples of silver halide used in the present invention partially contain a silver iodide crystal in its particle. That is, the silver halide the X-ray diffraction pattern of which show that of pure silver iodide are particularly preferred.

The photographic materials comprise a silver halide containing at least two silver halides each having different halogen. Such silver halides yield a completely mixed crystal in a conventional silver halide emulsion. For example, the particle of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its particle.

The process for preparing those silver halides is explained taking the case of silver iodobromide. That is, the silver iodobromide is prepared by adding silver nitride solution to potassium bromide solution to form silver bromide and further adding potassium iodide to the mixing solution.

The silver halide has a particle size of from 0.001 μm to 2 μm and, preferably, from 0.001 μm to 1 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process*, the Fourth Edition, Chapter 5, pp. 149–169.

Both silver halide and dye releasing compound may be incorporated into single layer, as well as silver halide may be incorporated into one layer and dye releasing compound may be incorporated into another layer coated on that layer.

A suitable coating amount of the light-sensitive silver halide used in the present invention is in a total of from 50 mg to 10 g/m$^2$ calculated as an amount of silver.

The binder which can be used in the present invention can be employed individually or in a combination of two or more. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

In the heat-developable color Photographic materials of the present invention, various kinds of dye releasing activator may be used. The dye releasing activator means a substance which attacks nucleophilically the dye releasing compound oxidized by the organic silver salt oxidizing agent to release a diffusible dye, and bases, base releasing agents and water releasing compounds are used. In these dye releasing activators, the bases and the base releasing agents are particularly preferred because they not only accelerate release of the dye but also accelerate the oxidation-reduction reaction between the organic silver salt oxidizing agent and the dye releasing compound.

Examples of preferred bases are amines which include trialkylamines, hydroxylamines, aliphatic polyamines, N-alkyl substituted aromatic amines, N-hydroxyalkyl substituted aromatic amines and bis[p-(dialkylamino)phenyl]methanes. Further, there are betaine tetramethylammonium iodide and diaminobutane dihydrochloride described in U.S. Pat. No. 2,410,644, and urea and organic compounds including amino acids such as 6-aminocaproic acid described in U.S. Pat. No. 3,506,444. The base releasing agent is a substance which releases a basic component by heating. Examples of typical base releasing agent have been described in British Pat. No. 998,949. A preferred base releasing agent is a salt of a carboxylic acid and an organic base, and examples of the suitable carboxylic acid include trichloroacetic acid and trifluoroacetic acid and examples of suitable base include guanidine, piperidine, morpholine, p-toluidine and 2-picoline, etc. Guanidine trichloroacetic acid described in U.S. Pat. No. 3,220,846 is particularly preferred. Further, aldonic amides described in Japanese Patent Application (OPI) No. 22625/75 are suitably used because they decompose at a high temperature to form a base.

The water releasing compound means a compound which releases water by decomposition during heat development to convert into a compound having a vapor pressure of $10^{-5}$ Torrs or more at a temperature of 100° to 200° C. These compounds are known in the field of printing of fabrics, and $NH_4Fe(SO_4)_2.12H_2O$, etc., described in Japanese Patent Application (OPI) No. 88386/75 are useful.

These dye releasing activators can be used in an amount of a broad range. It is preferably used in an amount in the range of 1/100 to 10 times and, preferably, 1/20 to 2 times by molar ratio based on silver.

Further, in the heat-developable color photographic light-sensitive materials of the present invention, it is possible to use compounds which activate development simultaneously while stabilizing the images. Particularly, it is suitable to use isothiuroniums including 2-hydroxyethylisothiuronium trichloroacetate described in U.S. Pat. No. 3,301,678, bisisothiuroniums including 1,8-(3,6-dioxaoctane)-bis(isothiuronium trifluoroacetate), etc., described in U.S. Pat. No. 3,669,670, thiol compounds described in German Patent Application (OLS) No. 2,162,714, thiazolium compounds such as 2-amino-2-thiazolium trichloroacetate, 2-amino-5-bromo-ethyl-2-thiazolium trichloroacetate, etc., described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., described in U.S. Pat. No. 4,060,420, and compounds having 2-carboxycarboxamide as an acid part described in U.S. Pat. No. 4,088,496.

These compounds or mixtures thereof can be used in a wide range of amounts. It is preferable to use them in a range of 1/100 to 10 times and, preferably, 1/20 to 2 times by molar ratio based on silver.

When the photographic material is heated, the reducing agent, the dye releasing compound, in the case of the present invention reduces the silver halide in the presence of the latent image nuclei as a catalyst to form silver, while it is oxidized itself. The oxidized product of the dye releasing compound is attached by a nucleophilic reagent (a dye releasing activator in the case of the present invention) to release a dye.

When organic silver salt oxidizing agents are employed in the photographic material of the present invention, the coloring density thereof can be increased because of extremely high coloring efficiency and furthermore the temperature for developing the same can be lowered, which is extremely advantageous for the photographic materials.

The organic silver salt oxidizing agent which can be used in the present invention is a silver salt which is comparatively stable to light and which forms a silver image by reacting with the above described image forming compound or a reducing agent coexisting, if necessary, with the image forming compound, when it is heated to a temperature of above 80° C. and, preferably, above 100° C. in the presence of exposed silver halide.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate and silver camphorate, etc. These silver salts which are substituted with a halogen atom or a hydroxyl group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)benzothiazole, a silver salt of thioglycolic acid such as a silver salt of an S-alkyl thioglycolic acid (wherein the alkyl group has from 12 to 22 carbon atoms) as described in Japanese Patent Application (OPI) No. 28221/73, a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are examples of the organic metal salt oxidizing agent capable of being used in the present invention.

The mechanism of the heat-development process under heating in the present invention is not entirely clear, but it is believed to be as follows.

When the photographic material is exposed to light, a latent image is formed in a light-sensitive silver halide. This phenomenon is described in T. H. James, *The Theory of the Photographic Process,* Third Edition, pages 105–148.

The silver halide and the organic silver salt oxidizing agent which form a starting point of development should be present within a substantially effective distance.

For this purpose, it is desired that the silver halide and the organic silver salt oxidizing agent are present in the same layer.

The silver halide and the organic metal salt oxidizing agent which are separately formed can be mixed prior to use to prepare a coating solution, but it is also effective to blend both of them in a ball mill for a long period of time. Further, it is effective to use a process which comprises adding a halogen containing compound to the organic silver salt oxidizing agent prepared to form silver halide using silver of the organic silver salt oxidizing agent.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

The organic silver salt oxidizing agent used in the present invention is suitably contained in an amount in the range of from 0.1 mol to 200 mols per mol of the silver halide.

A suitable coating amount of the light-sensitive silver halide and the organic silver salt oxidizing agent employed in the present invention is in a total of from 50 mg to 10 g/m$^2$ calculated as an amount of silver.

The light-sensitive silver halide and the organic silver salt oxidizing agent used in the present invention are prepared in the binder as described above. Further, the dye releasing compound is dispersed in the binder described above.

The polyethylene glycol type nonionic surface active agents used for the present invention are characterized by comprising a repeating unit of ethylene oxide in their molecules. It is particularly preferred that the molecule contains 5 or more of the repeating units of ethylene oxide.

The nonionic surface active agents capable of satisfying the above described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts,* (edited by Schöufeldt N. Pergamon Press, 1969). Among the nonionic surface active agents described in the above mentioned references, those capable of satisfying the above described conditions are preferably employed in connection with the present invention.

Preferred examples of the nonionic surface active agents include an alcohol ethylene oxide adduct, an alkylphenol ethylene oxide adduct, a fatty acid ethylene oxide adduct, a polyalcohol fatty acid ester ethylene oxide adduct, an alkylamine ethylene oxide adduct, a fatty acid amide ethylene oxide adduct, an ethylene oxide adduct of fats and oils and a polypropylene glycol ethylene oxide adduct.

Examples of the alcohol ethylene oxide adducts include those synthesized with synthetic alcohols such as lauryl alcohol, cetyl alcohol and oleyl alcohol; as well as natural alcohols such as coconut oil reduced alcohol, and beef tallow reduced alcohol, as a starting material. In addition, an oxo alcohol, a secondary alcohol or etc., each having a methyl group as a branch can be used as the starting material. The alcohol ethylene oxide adducts containing two or more kinds of alcohols in their molecules show the same advantageous properties as those containing a single alcohol.

Examples of the alkylphenol ethylene oxide adducts include those synthesized with alcohols such as nonylphenol, dodecylphenol, octylphenol or octylcresol, as a starting material. A branched chain alkylphenol or a straight chain alkylphenol can be effectively used.

The fatty acid ethylene oxide adducts are so-called polyethylene glycol ester type nonionic surface active agent, examples of which include those synthesized with a higher fatty acid such as lauric acid, oleic acid, or etc., as a starting material.

Examples of the polyalcohol fatty acid ester ethylene oxide adducts include those synthesized with a partial ester of a polyalcohol such as glycerol or sorbitol, and a fatty acid as a starting material.

Examples of the ethylene oxide adducts of alkylamine and fatty acid amide include those synthesized with amines such as laurylamine or oleic acid amide as a starting material.

Examples of the polypropylene glycol ethylene oxide adducts include those synthesized with polypropylene glycol having a molecular weight of 1,000 to 2,500 as a starting material for the hydrophobic group.

The nonionic surface active agents can be used independently or as a mixture of two or more of them.

The polyethylene glycol type nonionic surface active agents of the present invention can be used in an amount of less than 100% by weight, preferably less than 50% by weight, based on a hydrophilic binder.

It is somewhat unclear with respect why the polyethylene glycol type nonionic surface active agents of the present invention are effective. However, one opinion is that the polyethylene glycol type nonionic surface active agents of the present invention act as a solvent with respect to the dye image forming substance. It should be noted, however, that this opinion cannot explain why the surface active agents are effective for both a hydrophilic dye image forming substance and an oleophilic dye image forming substance.

In the heat-developable color photographic materials of the present invention, it is possible to use a thermal solvent. The term "thermal solvent" means a non-hydrolyzable organic material which is solid at an ambient temperature but melts together with other components at a temperature of heat treatment or below. Preferred examples of thermal solvents include compounds which can act as a solvent for the developing agent and compounds having a high dielectric constant which accelerate physical development of silver salts. Examples of preferred thermal solvents include polyglycols described in U.S. Pat. No. 3,347,675, for example, polyethylene glycol having an average molecular weight of 1,500 to 20,000, derivatives of polyethylene oxide such as oleic acid ester, etc., beeswax, monostearin, compounds having a high dielectric constant which have —$SO_2$— or —CO— such as acetamide, succinimide, ethylcarbamate, urea, methylsulfonamide or ethylene carbonate, polar substances described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate described in *Research Disclosure,* pp. 26–28 (Dec. 1976), etc.

In the present invention, though it is not necessary to incorporate substances or dyes for preventing irradiation or halation in the photographic materials, because the photographic materials are colored by the dye releasing compound, it is possible to add filter dyes or light absorbent materials, etc., described in Japanese Patent Publication No. 3692/73 and U.S. Pat. Nos. 3,253,921, 2,527,583 and 2,956,879 in order to improve sharpness. It is preferred that these dyes have a thermal bleaching property. For example, dyes described in U.S. Pat. Nos. 3,769,019, 3,745,009 and 3,615,432 are preferred.

The photographic materials according to the present invention may contain, if necessary, various additives known for the heat-developable photographic materials and may have a layer other than the light-sensitive layer, for example, an antistatic layer, an electrically conductive layer, a protective layer, an intermediate layer, an AH layer and a strippable layer, etc. Examples of additives include those described in *Research Disclosure,* Vol. 170, No. 17029 (June, 1978), for example, plasticizers, dyes for improving sharpness, AH dyes, sensitizing dyes, matting agents, surface active agents, fluorescent whitening agents and fading preventing agents, etc.

The protective layer, the intermediate layer, the subbing layer, the back layer and other layers can be produced by preparing each coating solution and applying to a support by various coating methods such as a dip coating method, an air-knife coating method, a curtain coating method or a hopper coating method as described in U.S. Pat. No. 2,681,294 and drying. Similar methods can be used in preparing the heat-developable photographic layer of the present invention, by which the photographic material is obtained.

If necessary, two or more layers may be applied at the same time by the method described in U.S. Pat. No. 2,761,791 and British Pat. No. 837,095.

Various means of exposure can be used in connection with the heat-developable photographic materials of the present invention. Latent images are obtained by imagewise exposure by radiant rays including visible rays. Generally, light sources used for conventional color prints can be used, examples of which include tungsten lamps, mercury lamps, halogen lamps such as an iodine lamp, a xenon lamp, laser light sources, CRT light sources, fluorescent tubes and light-emitting diodes, etc.

The original may be line drawings or photographs having gradation. Further, it is possible to take a photograph of a portrait or landscape by means of a camera. Printing from the original may be carried out by contact printing by putting the original in close contact with the material or may be carried out by reflection printing or enlargement printing.

It is also possible to carry out the printing of images photographed by a videocamera or image informations sent from a television broadcasting station by displaying on a cathode ray tube (CRT) or a fiber optical tube (FOT) and forcusing the resulting image on the heat-developable photographic material by contacting therewith or by means of a lens.

Recently, light-emitting diode (LED) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The photographic material to be sensitized by these lights is produced so as to release a yellow dye, a magenta dye and a cyan dye, respectively.

The photographic material is produced using a construction such that the green-sensitive part (layer) contains a yellow dye releasing compound, the red-sensitive part (layer) contains a magenta dye releasing compound and the infrared-sensitive part (layer) contains a cyan dye releasing compound. Other combinations can be utilized, if necessary.

In addition to the above described methods of contacting or projecting the original, there is a method of exposure wherein the original illuminated by a light source is stored in a memory of a leading computer by means of a light-receiving element such as a phototube or a charge coupling device (CCD). The resulting information is, if necessary, subjected to processing, the so-called image treatment, and resulting image information is reproduced on CRT which can be utilized as an image-like light source or lights are emitted by three kinds of LED according to the processed information.

After the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above described temperature range. Particularly, a temperature range of about 110° C. to about 160° C. is useful. As the heating means, a simple heat plate, iron, heat roller or analogues thereof may be used.

In the present invention, a specific method for forming a color image by heat development comprises diffusion transfer of a hydrophilic diffusible dye. For this purpose, the heat-developable color photographic material is composed of a support having thereon a light-sensitive layer (I) containing at least silver halide, an organic silver salt oxidizing agent, a dye releasing compound which is also a reducing agent for the organic silver salt oxidizing agent, a hydrophilic binder and a dye releasing activator, and an image receiving layer (II) capable of receiving the hydrophilic diffusible dye formed in the light-sensitive layer (I).

The above described light-sensitive layer (I) and the image receiving layer (II) may be formed on the same support, or they may be formed on different supports, respectively. The image receiving layer (II) can be stripped off the light-sensitive layer (I). For example, after the heat-developable color photographic material is exposed imagewise to light, it is developed by heating uniformly and thereafter the image receiving layer (II) is peeled apart.

In accordance with another process, after the heat-developable color photographic material is exposed imagewise to light and developed by heating uniformly, the dye can be transferred on the image receiving layer (II) by superposing the image receiving layer on the light-sensitive layer (I) and heating to a temperature lower than the developing temperature. The temperature lower than the developing temperature in such a case includes a room temperature and preferably a temperature from a room temperature to a temperature not less than about 40° C. lower than the heat-developing temperature. For example, a heat-developing temperature and a transferring temperature are 120° C. and 80° C., respectively. Further, there is a method wherein only the light-sensitive layer (I) is exposed imagewise to light and then developed by heating uniformly by superposing the image receiving layer (II) on the light-sensitive layer (I).

The image receiving layer (II) can contain a dye mordant. In the present invention, various mordants can be used, and a useful mordant can be selected according to properties of the dye, conditions for transfer, and other components contained in the photographic material, etc. The mordants which can be used in the present invention include high molecular weight polymer mordants.

Polymer mordants to be used in the present invention are polymers containing secondary and tertiary amino groups, polymers containing nitrogen-containing hetero-ring moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc.

In addition, mordants disclosed in U.S. Pat. Nos. 2,675,316 and 2,882,156 can be used.

Of these mordants, those which migrate with difficulty from a mordanting layer to other layers are preferable; for example, mordants capable of cross-linking with a matrix such as gelatin, water-insoluble mordants, and aqueous sol (or latex dispersion) type mordants are preferably used.

Particularly preferable polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc.), such as

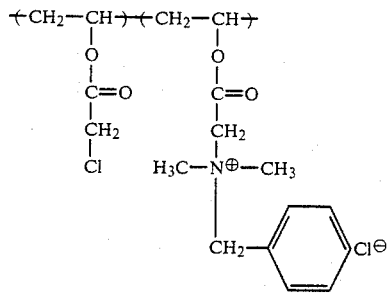

(2) Reaction products between a copolymer of a monomer represented by the following general formula with another ethylenically unsaturated monomer and a cross-linking agent (for example, bisalkanesulfonate, bisarenesulfonate, etc.):

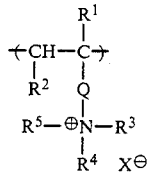

wherein $R^1$ represents H or an alkyl group, $R^2$ represents H, an alkyl group or an aryl group, Q represents a divalent group, $R^3$, $R^4$ and $R^5$ each represents an alkyl group, an aryl group or at least two or $R^3$ to $R^5$ are bonded together to form a hetero ring, and X represents an anion. The above described alkyl groups and aryl groups may be substituted.

(3) Polymers represented by the following general formula

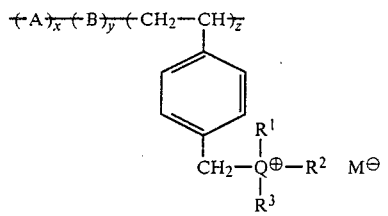

wherein x is from about 0.25 mol% to about 5 mol%, y is from about 0 mol% to about 90 mol%, z is from about 10 mol% to about 99 mol%, A represents a monomer having at least two ethylenically unsaturated bonds, B represents a copolymerizable ethylenically unsaturated monomer, Q represents N or P, $R^1$, $R^2$ and $R^3$ each represents an alkyl group or a cyclic hydrocarbon group or at least two of $R^1$ to $R^3$ are bonded together to form a ring (these groups and rings may be substituted), and M represents an anion.

(4) Copolymers composed of (a), (b) and (c), wherein (a) is

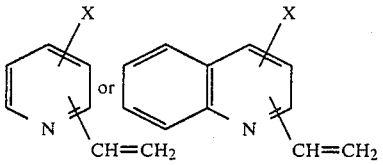

wherein X represents hydrogen, an alkyl group or a halogen atom (the alkyl group may be substituted);

(b) is an acrylic ester; and (c) is acrylonitrile.

(5) Water-insoluble polymers wherein at least $\frac{1}{3}$ of the repeating units are those represented by the following general formula

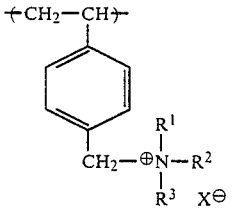

wherein $R^1$, $R^2$ and $R^3$ each represents an alkyl group, with the total number of carbon atoms being 12 or more (the alkyl group may be substituted), and X represents an anion.

Various kinds of known gelatins can be employed as gelatin for the mordant layer. For example, gelatin which is produced in a different manner such as lime-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the image-forming process used. Preferably, the ratio of mordant to gelatin is from about 20/80 to 80/20 (by weight) and the amount of the mordant coated is from 0.5 to 8 g/m$^2$.

The image receiving layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which is observed through the transparent support is obtained.

Typical image receiving materials for diffusion transfer are obtained by mixing the polymer containing ammonium salt groups with gelatin and applying the mixture to a transparent support.

The transfer of dyes from the photographic light-sensitive layer to the image receiving layer can be carried out using a transfer solvent. Examples of useful transfer solvents include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The transfer solvent can be employed by wetting the image receiving layer with the transfer solvent or by incorporating it in the form of water of crystallization or microcapsules into the photographic material.

The present invention will be explained in greater detail with reference to the following examples, but the present invention should not be construed as being limited thereto.

EXAMPLE 1

6.5 g of benzotriazole and 10 g of gelatin were dissolved in 1,000 ml of water and the solution was stirred while maintaining the temperature at 50° C. A solution containing 8.5 g of silver nitrate dissolved in 100 ml of water was added to the above described solution over a period of 2 minutes. Then, a solution containing 1.2 g of potassium bromide dissolved in 50 ml of water was added for a period of 2 minutes. By controlling the pH of the emulsion thus prepared precipitate was formed and the excess salts were removed. The pH of the emulsion was then adjusted to 6.0 and 200 g of the emulsion was obtained.

In the following, a method of preparing a gelatin dispersion of a dye releasing compound is described.

A mixture of 10 g of Dye Releasing Compound (10), 0.5 g of sodium 2-ethylhexylsulfosuccinate, 20 g of tricresyl phosphate (TCP) and 20 ml of cyclohexanone was heated at about 60° C. to form a uniform solution. The solution was mixed with 100 g of a 10% aqueous solution of gelatin and then dispersed using a homogenizer at 10,000 rpm for 10 minutes. The dispersion thus prepared is designated a dispersion of a dye releasing compound.

In the following, a method of preparing a light-sensitive coating is described.

| | |
|---|---|
| (a) a silver benzotriazole emulsion containing a light-sensitive silver bromide | 10 g |
| (b) a dispersion of a dye releasing compound | 3.5 g |
| (c) a solution containing 220 mg of guanidine trichloroacetate dissolved in 2 ml of methanol | |

The above-described components (a), (b) and (c) were mixed and dissolved by heating. The solution was coated on a polyethylene terephthalate film having a thickness of 180μ at a wet thickness of 60 μm and dried. The sample thus prepared was exposed imagewise at 2,000 lux for 10 seconds using a tungsten lamp and then uniformly heated on a heat block which has been heated at 150° C. for 30 seconds.

In the following, a method of preparing an image receiving material having an image receiving layer is described.

10 g of copolymer of methyl acrylate and N,N,N-trimethyl-N-vinylbenzyl ammonium chloride (a ratio of methyl acrylate and vinyl benzyl ammonium chloride being 1:1) was dissolved in 200 ml of water and the solution was uniformly mixed with 100 g of a 10% aqueous solution of lime-processed gelatin. The mixture was uniformly coated on a polyethylene terephthalate film at a wet thickness of 20 μm and dried to prepare an image receiving material.

The image receiving material was soaked in water and superposed on the heated photographic material described above in order to bring them into contact with each of the surface layers. After 30 seconds, the image receiving material was peeled apart from the photographic material to obtain a negative magenta color image on the image receiving material. The optical density of the negative image was measured using a Macbeth transmission densitometer (TD-504). The maximum density and the minimum density to green light were 2.40 and 0.12, respectively. Further, the gradation of the sensitometric curve showed a density difference of 1.35 to an exposure difference of 10 times in the straight line part.

EXAMPLES 2 TO 5

The same procedure as described in Example 1 was repeated except using 10 g of Dye Releasing Compound (1) in place of Dye Releasing Compound (10) to prepare Photographic Material No. 2.

In the same manner, Photographic Material Nos. 3 to 5 were prepared using 10.5 g of Dye Releasing Compound (2), 10.5 g of Dye Releasing Compound (17) and 11.0 g of Dye Releasing Compound (19), respectively.

These Photographic Material Nos. 2 to 5 were subjected to the same process as described in Example 1 to obtain negative color images on the image receiving materials. The results of the optical density measurement are shown in the following table.

| Photographic Material No. | Dye Releasing Compound | Hue | Maximum Color Density | Minimum Color Density |
|---|---|---|---|---|
| 2 | 1 | Yellow | 1.2 | 0.08 |
| 3 | 2 | " | 1.4 | 0.08 |
| 4 | 17 | Cyan | 2.1 | 0.10 |
| 5 | 19 | " | 2.0 | 0.11 |

EXAMPLE 6

The same procedure and process as described in Example 1 were repeated except without using guanidine trichloroacetate. As a result, only a faint magenta color image (having the maximum density of 0.18) was obtained. Then, the temperature of the heat block was raised to 180° C. and the photographic material was uniformly heated for 30 seconds followed by the same transfer process as described in Example 1, a negative image having the maximum density of 0.80 and the minimum density of 0.20 was obtained.

EXAMPLE 7

The same procedure and process as described in Example 1 were repeated except using 0.12 g of diethylaminoethanol in place of guanidine trichloroacetate. As a result, a negative magenta color image having the maximum density of 1.90 and the minimum density of 1.30 was obtained on the image receiving material.

EXAMPLE 8

The same procedure and process as described in Example 1 were repeated except adding 0.4 g of 1-phenyl-4-methyl-4-oxymethyl-3-pyrazolidinone as an auxiliary developing agent to the light-sensitive coating of Example 1. As a result, a magenta color image having the maximum density of 2.50 and the minimum density of 0.12 was obtained. These results are almost same as those obtained in Example 1 and this indicates that it is possible to form a sufficient image without using the auxiliary developing agent according to the present invention.

EXAMPLE 9

In the dye transfer process as described in Example 1, an image receiving material was soaked in a 0.1N aqueous sodium hydroxide solution in place of the soaking in water. As a result, a magenta color image having the maximum color density of 2.5 and the minimum color density of 0.40 was obtained.

EXAMPLE 10

An emulsion was prepared using 3-amino-5-benzylthio-1,2,4-triazole in the following manner. 14 g of gelatin and 11.3 g of 3-amino-5-benzylthio-1,2,4-triazole were dissolved in a mixture of 1,000 ml of water and 300 ml of methanol. The solution was maintained at 50° C. with stirring to which a solution containing 8.5 g of silver nitrate dissolved in 50 ml of water was added for a period of 5 minutes. After standing for 5 minutes, a solution containing 1.2 g of potassium bromide dissolved in 50 ml of water was added for a period of 5 minutes. The temperature of the solution was decreased to 40° C. and the undesirable salts were removed by a flocculation method to obtain 200 g of the emulsion.

The same procedure and process as described in Example 1 were repeated except using 10 g of the light-sensitive silver 3-amino-5-benzylthio-1,2,4-triazole emulsion described above. As a result, a negative magenta color image having the maximum density of 2.25 and the minimum density of 0.11 was obtained on the image receiving material.

EXAMPLE 11

6.5 g of benzotriazole and 10 g of gelatin were dissolved in 1,000 ml of water and the solution was stirred while maintaining the temperature at 50° C. A solution containing 8.5 g of silver nitrate dissolved in 100 ml of water was added to the above described solution over a period of 2 minutes. Then, a solution containing 1.2 g of potassium bromide dissolved in 50 ml of water was added for a period of 2 minutes. By controlling the pH of the emulsion thus prepared precipitate was formed and the excess salts were removed. The pH of the emulsion was then adjusted to 6.0 and 200 g of the emulsion was obtained.

In the following, a method of preparing a gelatin dispersion of a dye image forming substance is described.

A mixture of 10 g of the dye image forming substance represened by the following formula, 0.5 g of sodium 2-ethylhexylsulfosuccinate as a surface active agent, 20 g of tricresyl phosphate (TCP) and 30 ml of ethyl acetate was heated at about 60° C. to form a uniform solution.

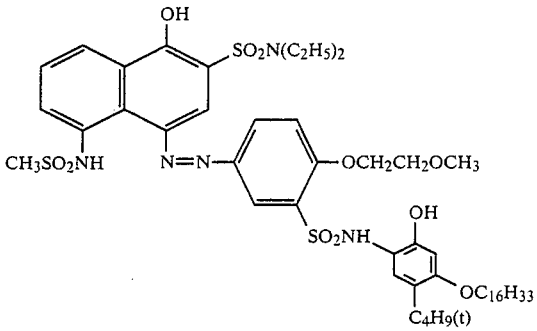

The solution was mixed with 100 g of a 10% aqueous solution of lime-processed gelatin and then dispersed using a homogenizer at 10,000 rpm for 10 minutes. The dispersion thus prepared is designated a dispersion of a dye image forming substance.

In the following, a method of preparing a light-sensitive coating is described.

| | |
|---|---|
| (a) | A silver benzotriazole emulsion containing a light-sensitive silver bromide 10 g |
| (b) | a dispersion of a dye image forming substance 3.5 g |
| (c) | a solution containing 250 mg of guanidine trichloroacetate dissolved in 2 ml of ethanol |
| (d) | a solution containing 200 mg of the compound of the present invention represented by the following formula dissolved in 4 ml of ethanol |

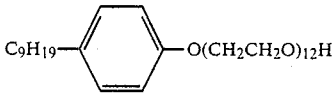

The above-described components (a) to (d) were mixed and dissolved by heating. The solution was coated on a polyethylene terephthalate film having a thickness of 180 μm at a wet thickness of 60 μm and dried. The sample thus prepared was exposed imagewise at 2,000 lux for 10 seconds using a tungsten lamp and then uniformly heated on a heat block which has been heated at 120° C. for 30 seconds. The resulting sample was referred to as Sample A.

Then, the same procedure as described above was repeated except for using 4 ml of water in place of (d) a solution containing 200 mg of the compound of the present invention dissolved in 4 ml of ethanol to prepare a sample. The resulting sample was referred to as Sample B.

In the following, a method of preparing an image receiving material having an image receiving layer is described.

10 g of copolymer of methyl acrylate and N,N,N-trimethyl-N-vinylbenzyl ammonium chloride (a ratio of methyl acrylate and vinyl benzyl ammonium chloride being 1:1) was dissolved in 200 ml of water and the solution was uniformly mixed with 100 g of a 10% aqueous solution of lime-processed gelatin. The mixture was uniformly coated on a polyethylene terephthalate film at a wet thickness of 20 μm and dried to prepare an image receiving material.

The image receiving material was soaked in water and superposed on the heated photographic material A or B described above in order to bring them into contact with each of the surface layers. After heating them for 6 seconds on a heat block at a temperature of 80° C., the image receiving material was peeled apart from the photographic material to obtain a negative magenta color image on the image receiving material. The optical density of the negative image was measured using a Macbeth transmission densitometer (TD-504). The results are shown below.

| Sample No. | Maximum Color Density | Minimum Color Density |
|---|---|---|
| A (The present invention) | 2.10 | 0.18 |
| B (Comparison) | 0.35 | 0.15 |

From the results shown in the above table, it can be seen that the compound of the present invention gave extremely high density even at a comparatively low temperature.

EXAMPLE 12

The same procedure as described in Example 11 was repeated except for using a compound represented by the formula shown in the following table in place of the compound of the present invention in solution (d) to prepare samples. The resulting samples were referred to as Samples C to K. Each sample was processed by the same manner as described in Example 11 to measure the optical density. The results are shown below.

| Sample No. | Compound | Maximum Color Density |
|---|---|---|
| C | 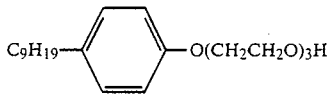 | 0.42 |
| D (The Present Invention) | 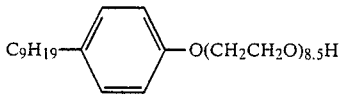 | 1.90 |
| E (The Present Invention) | 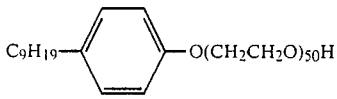 | 2.05 |
| F | Polyethylene glycol (average molecular weight = 1,000) | 0.50 |
| G (The Present Invention) | Polyethylene glycol (average molecular weight = 1,000) | 1.75 |
| H (The Present Invention) | $H_{23}C_{11}COO(CH_2CH_2O)_{30}H$ | 2.15 |
| I (The Present Invention | $H_{25}C_{12}O(CH_2CH_2O)_{10}H$ | 1.70 |
| J | $H_7C_3COO(CH_2CH_2O)_{10}H$ | 0.90 |

-continued

| Sample No. | Compound | Maximum Color Density |
|---|---|---|
| (The Present Invention) | | |
| K | $H_3CO(CH_2CH_2O)_2CH_3$ | 0.35 |

From the results shown in the above table, it can be seen that the compounds of the present invention gave superior results as compared to the compound falling outside the scope of the present invention.

EXAMPLE 13

The same procedure as described in Example 11 was repeated except for using the compounds represented by the following formulae [α] and [β] in place of the dye image forming substance in dispersion (b) and furthermore except for using another polyethylene glycol type nonionic surface active agent represented by the following formula [γ] in place of the polyethylene glycol type nonionic surface active agents of the present invention in solution (d) according to the combinations shown in the following table to prepare samples. The resulting samples were referred to as Samples L, M, N and O.

[α]

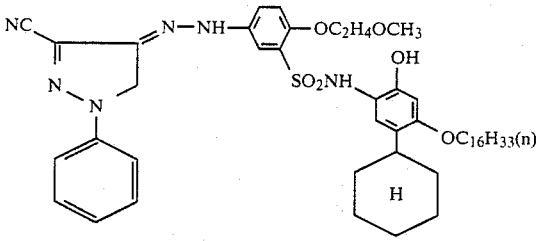

[β]

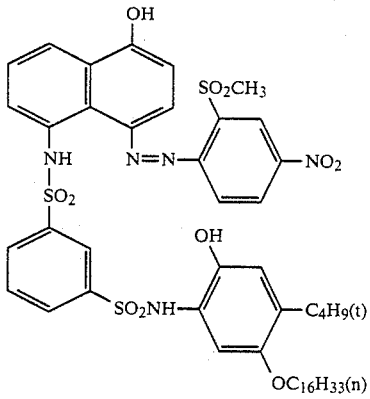

[γ]

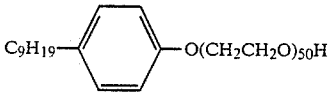

Each sample was processed by the same manner as described in Example 11 to measure the optical density. The results are shown below.

| Sample No. | Dye Image Forming Substance | Surface Active Agent | Maximum Color Density | Minimum Color Density |
|---|---|---|---|---|
| L | Compound α | Present | 1.25 | 0.14 |
| M | " | None | 0.21 | 0.16 |
| N | Compound β | Present | 1.95 | 0.15 |
| O | " | None | 0.28 | 0.18 |

From the results shown in the above table, it can be seen that the polyethylene glycol type nonionic surface active agent of the present invention produced an extremely high density image even at a comparatively low temperature.

EXAMPLE 14

26 g of potassium bromide and 40 g of gelatin were dissolved in 3,000 ml of water and the solution was stirred while maintaining the temperature at 50° C. A solution containing 34 g of silver nitrate dissolved in 200 ml of water was added to the above described solution over a period of 10 minutes. Then, a solution containing 3.3 g of potassium iodide dissolved in 100 ml of water was added for a period of 2 minutes. By controlling the pH of the silver iodobromide emulsion thus prepared precipitate was formed and the excess salts were removed. The pH of the emulsion was then adjusted to 6.0 and 400 g of the silver iodobromide emulsion was obtained.

In the following, a method of preparing a gelatin dispersion of a dye releasing compound is described.

A mixture of 10 g of Dye Releasing Compound (10), 0.5 g of sodium 2-ethylhexylsulfosuccinate as a surface active agent, 20 g of tricresyl phosphate (TCP) and 30 ml of ethyl acetate was heated at about 60° C. to form a uniform solution. The solution was mixed with 100 g of a 10% aqueous solution of lime-processed gelatin and then dispersed using a homogenizer at 10,000 rpm for 10 minutes. The dispersion thus prepared is designated a dispersion of a dye releasing compound.

In the following, a method of preparing a light-sensitive coating is described.

| | |
|---|---|
| (a) a light-sensitive silver iodobromide emulsion | 5 g |
| (b) a dispersion of a dye releasing compound | 3.5 g |
| (c) a solution containing 400 mg of guanidien trichloroacetate dissolved in 4 ml of ethanol | |

The above-described components (a), (b) and (c) were mixed and dissolved by heating. The solution was coated on a polyethylene terephthalate film having a thickness of 180μ at a wet thickness of 60 μm and dried. The sample thus prepared was exposed imagewise at 2,000 lux for 10 seconds using a tungsten lamp and then uniformly heated on a heat block which has been heated at 150° C. for 30 seconds.

In the following, a method of preparing an image receiving material having an image receiving layer is described.

10 g of copolymer of methyl acrylate and N,N,N-trimethyl-N-vinylbenzyl ammonium chloride (a ratio of methyl acrylate and vinyl benzyl ammonium chloride being 1:1) was dissolved in 200 ml of water and the solution was uniformly mixed with 100 g of a 10% aqueous solution of lime-processed gelatin. The mixture was uniformly coated on a polyethylene terephthalate film at a wet thickness of 20 μm and dried to prepare an image receiving material.

The image receiving material was soaked in water and superposed on the heated photographic material described above in order to bring them into contact with each of the surface layers. After 30 seconds, the image receiving material was peeled apart from the photographic material to obtain a negative magenta color image on the image receiving material. The optical density of the negative image was measured using a Macbeth transmission densitometer (TD-504). The maximum density and the minimum density to green light were 2.20 and 0.20, respectively. Further, the gradation of the sensitometric curve showed a density difference of 1.40 to an exposure difference of 10 times in the straight line part.

EXAMPLES 15 TO 18

The same procedure as described in Example 14 was repeated except using 10 g of Dye Releasing Compound (1) in place of Dye Releasing Compound (10) to prepare Photographic Material No. 15.

In the same manner, Photographic Material Nos. 16 to 18 were prepared using 10.5 g of Dye Releasing Compound (2), 10.5 g of Dye Releasing Compound (17) and 11.0 g of Dye Releasing Compound (19), respectively.

These Photographic Material Nos. 15 to 18 were subjected to the same process as described in Example 14 to obtain negative color images on the image receiving materials. The results of the optical density measurement are shown in the following table.

| Photographic Material No. | Dye Releasing Compound | Hue | Maximum Color Density | Minimum Color Density |
|---|---|---|---|---|
| 15 | 1 | Yellow | 1.05 | 0.07 |
| 16 | 2 | " | 1.30 | 0.08 |
| 17 | 17 | Cyan | 1.82 | 0.09 |
| 18 | 19 | " | 1.83 | 0.09 |

While the invention has been described in detail and with reference to specific embodiments thereof, it will be apparent to one skilled in the art that various changes and modifications can be made therein without departing from the spirit and scope thereof.

What is claimed is:

1. A heat-developable color photographic material comprising a support having thereon at least a light-sensitive silver halide, an organic silver salt oxidizing agent, a hydrophilic binder, a dye releasing activator and a dye releasing compound represented by the following general formula and which is capable of reducing the organic silver salt oxidizing agent and/or the silver halide and which releases a hydrophilic dye, wherein said dye releasing compound is immobilized in a hydrophilic binder:

$$R—SO_2—D \quad (I)$$

wherein R represents a reducing group capable of being oxidized by the organic silver salt oxidizing agent; and D represents a dye portion for forming an image.

2. A heat-developable color photographic material as claimed in claim 1, wherein the color photographic material further contains a reducing agent for the organic silver salt oxidizing agent and/or silver halide.

3. A heat-developable color photographic material as claimed in claim 1, wherein the reducing group represented by R has an oxidation reduction potential to a saturated calomel electrode of 1.2 V or less.

4. A heat-developable color photographic material as claimed in claim 1, wherein the reducing group represented by R is represented by the following general formulae (II) to (IX):

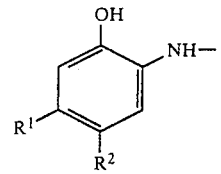
(II)

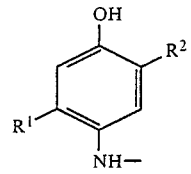
(III)

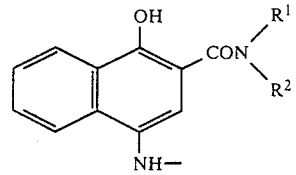
(IV)

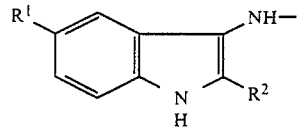
(V)

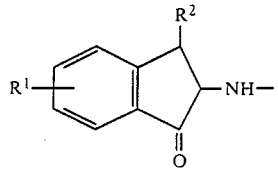
(VI)

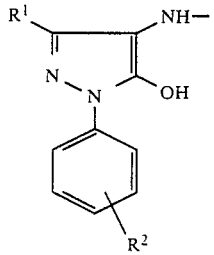
(VII)

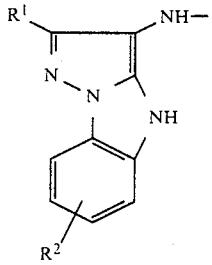
(VIII)

-continued

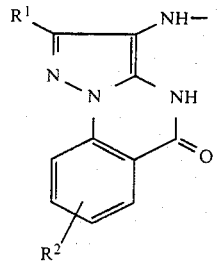

(IX)

wherein $R^1$ and $R^2$, which may be the same or different, each represents a hydrogen atom or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group.

5. A heat-developable color photographic material as claimed in claim 4, wherein the alkyl moiety or the aryl moiety in the substituent for $R^1$ and $R^2$ is further substituted with an alkoxy group, a halogen atom, a hydroxy group, a cyano group, an acyl group, an acylamino group, a substituted carbamoyl group, a substituted sulfamoyl group, an alkylsulfonylamino group, an arylsulfonylamino group, a substituted ureido group or a carboalkoxy group.

6. A heat-developable color photographic material as claimed in claim 1, wherein the reducing group represented by R is represented by the following general formula (X):

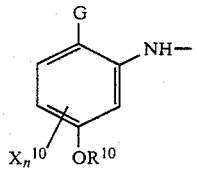

(X)

wherein G represents a hydroxy group or a group giving a hydroxy group upon hydrolysis; $R^{10}$ represents an alkyl group or an aromatic group; $X^{10}$ represents an electron donating group substituent when n is 1 or substituents, which may be the same or different, one of said substituents being an electron donating group and the second or second and third substituents being selected from the group consisting of an electron donating group or a halogen atom when n is 2 or 3; wherein $X^{10}$ groups may form a condensed ring, excluding an aromatic hydrocarbon ring, with each other or with $OR^{10}$; n is 1, 2 or 3 and the total carbon number of $X^{10}_n$ and $R^{10}$ is larger than 8.

7. A heat-developable color photographic material as claimed in claim 6, wherein the reducing group represented by R is represented by the following general formula (Xa):

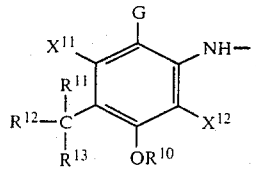

(Xa)

wherein G represents a hydroxy group or a group giving a hydroxy group upon hydrolysis; $R^{11}$ and $R^{12}$, which may be the same or different, each represents an alkyl group or $R^{11}$ and $R^{12}$ may be bonded to each other to form a ring; $R^{13}$ represents hydrogen or an alkyl group; $R^{10}$ represents an alkyl group or an aromatic group; $X^{11}$ and $X^{12}$, which may be the same or different, each represents hydrogen, an alkyl group, an alkoxy group, a halogen atom, an acylamino group or an alkylthio group; and $R^{10}$ and $X^{12}$ or $R^{10}$ and $R^{13}$ may be bonded to each other to form a ring.

8. A heat-developable color photographic material as claimed in claim 6, wherein the reducing group represented by R is represented by the following general formula (Xb):

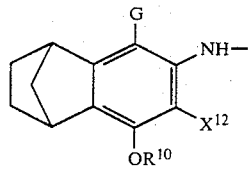

(Xb)

wherein G represents a hydroxy group or a group giving a hydroxy group upon hydrolysis; $R^{10}$ represents an alkyl group or an aromatic group; $X^{12}$ represents a hydrogen atom, an alkyl group, an alkoxy group, a halogen atom, an acylamino group, an alkylthio group; and $R^{10}$ and $X^{12}$ may be bonded to each other to form a ring.

9. A heat-developable color photographic material as claimed in claim 1, wherein the reducing group represented by R is represented by the following general formula (XI):

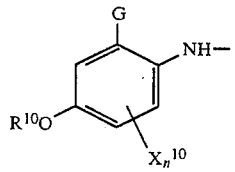

(XI)

wherein G represents a hydroxy group or a group giving a hydroxy group upon hydrolysis; $R^{10}$ represents an alkyl group or an aromatic group; $X^{10}$ represents an electron donating group substituent when n is 1 or substituents, which may be the same or different, one of said substituents being an electron donating group and the second or second and third substituents being selected from the group consisting of an electron donating group or a halogen atom when n is 2 or 3; wherein $X^{10}$ groups may form a condensed ring, excluding an aromatic hydrocarbon ring, with each other or with $OR^{10}$; n is 1, 2 or 3 and the total carbon number of $X^{10}_n$ and $R^{10}$ is larger than 8.

10. A heat-developable color photographic material as claimed in claim 9, wherein the reducing group represented by R is represented by the following general formula (XIa):

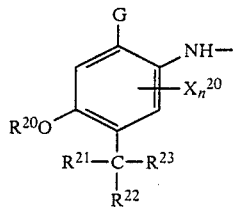

(XIa)

wherein G represents a hydroxy group or a group giving a hydroxy group upon hydrolysis; $R^{21}$ and $R^{22}$, which may be the same or different, each represents an alkyl group or an aromatic group, and $R^{21}$ and $R^{22}$ may be bonded to each other to form a ring; $R^{23}$ represents hydrogen, an alkyl group or an aromatic group; $R^{20}$ represents an alkyl group or an aromatic group; $X^{20}$ represents an alkyl group, an alkoxy group, an alkylthio group, an arylthio group, a halogen atom or an acylamino group; n is 0, 1 or 2; $R^{20}$ and $X^{20}$ may be bonded to each other to form a condensed ring; $R^{20}$ and $R^{21}$ may be bonded to each other to form a condensed ring; $R^{21}$ and $X^{20}$ may be bonded to each other to form a condensed ring; and the total number of the carbon atoms included in $R^{20}$, $R^{21}$, $R^{22}$, $R^{23}$ and $X^{20}_n$ is from 7 to 40.

11. A heat-developing color photographic material as claimed in claim 9, wherein the reducing group represented by R is represented by the following general formula (XIb):

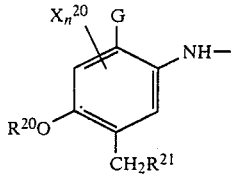

(XIb)

wherein G represents a hydroxy group or a group giving a hydroxy group upon hydrolysis; $R^{21}$ represents an alkyl group or an aromatic group; $R^{20}$ represents an alkyl group, an alkoxy group, an alkylthio group, an arylthio group, a halogen atom or an acylamino group; n is 0, 1 or 2; $R^{20}$ and $X^{20}$ may be bonded to each other to form a condensed ring; $R^{20}$ and $R^{21}$ may be bonded to each other to form a condensed ring; $R^{21}$ and $X^{20}$ may be bonded to each other to form a condensed ring; and the total number of the carbon atoms included in $R^{20}$, $R^{21}$ and $X^{20}_n$ is from 7 to 40.

12. A heat-developable color photographic material as claimed in claim 9, wherein the reducing group represented by R is represented by the following general formula (XIc):

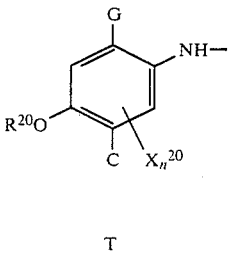

(XIc)

wherein G represents a hydroxy group or a group giving a hydroxy group upon hydrolysis; $R^{20}$ represents an alkyl group or an aromatic group; $X^{20}$ represents an alkyl group, an alkoxy group, an alkylthio group, an arylthio group, a halogen atom or an acylamino group; n is 0, 1 or 2; the group of

T C— represents a group in which 2 to 4 saturated hydrocarbon rings are condensed, the carbon atom (—C—)

in the condensed ring which is connected to the phenol nucleus (or a precursor thereof), a tertiary carbon atom which composes one of the pivot of the condensed ring, a part of the carbon atoms (excluding the above described tertiary carbon atom) in the hydrocarbon ring may be substituted for oxygen atom(s), the hydrocarbon ring may have a substituent, and an aromatic ring may be further condensed to the hydrocarbon ring; $R^{20}$ or $X^{20}$ and the group of

T C— may be bonded to each other to form a condensed ring; and the total number of the carbon atoms included in $R^{20}$, $X^{20}_n$ and the group of

T C— is from 7 to 40.

13. A heat-developable color photographic material as claimed in claim 1, wherein the reducing group represented by R is represented by the following general formula (XII):

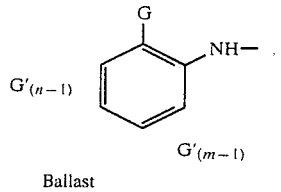

(XII)

wherein Ballast represents an organic ballasting radical of such molecular size and configuration as to render said compound nondiffusible during development in an alkaline processing composition; G represents a hydroxy group or a group giving a hydroxy group upon hydrolysis; G' represents an aromatic ring directly condensed to the benzene nucleus to form a naphthalene nucleus; and n and m are dissimilar positive integers of 1 to 2.

14. A heat-developable color photographic material as claimed in claim 1, wherein the dye portion represented by D includes an azo dye, an azomethine dye, an anthraquinone dye, a naphthoquinone dye, a styryl dye, a nitro dye, a quinoline dye, a carbonyl dye or a phthalocyanine dye.

15. A heat-developable color photographic material as claimed in claim 14, wherein the dye included in the dye portion represented by D is represented by the following general formula:

Yellow:

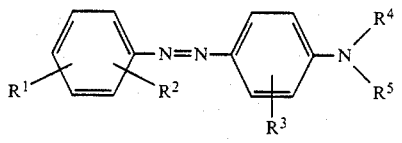

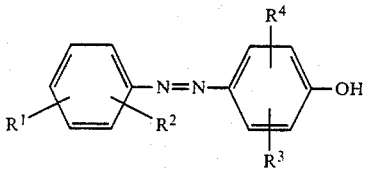

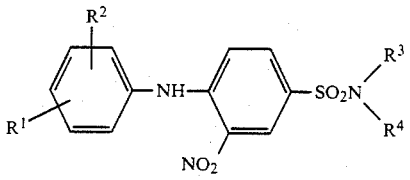

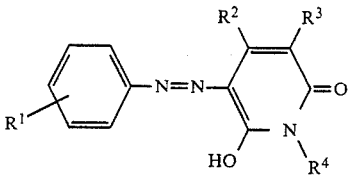

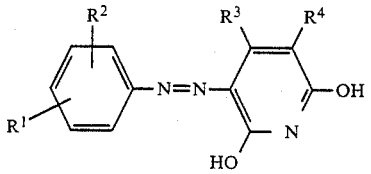

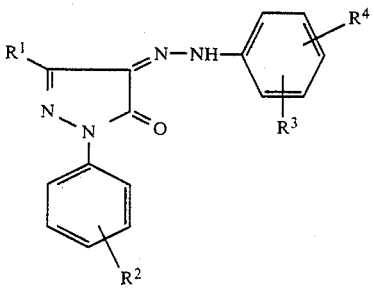

-continued

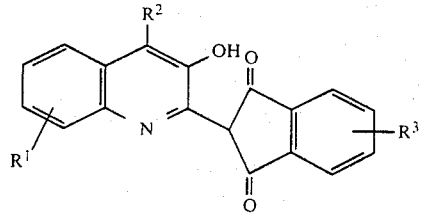

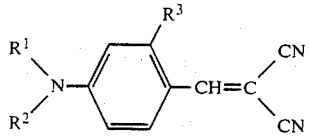

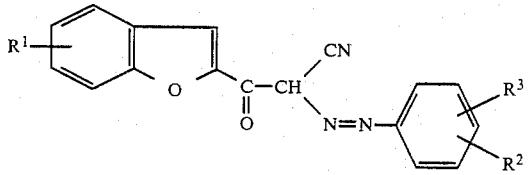

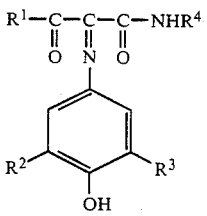

Magenta:

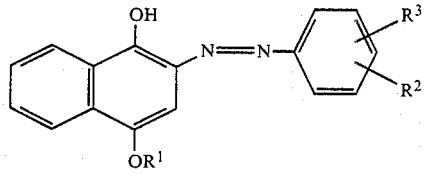

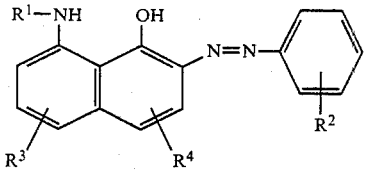

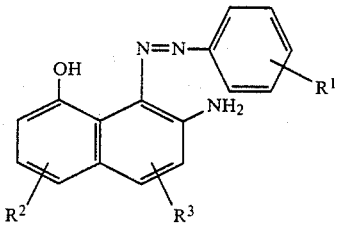

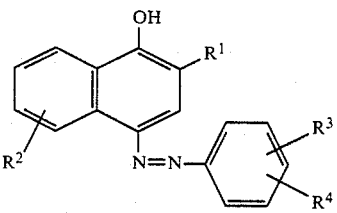

-continued
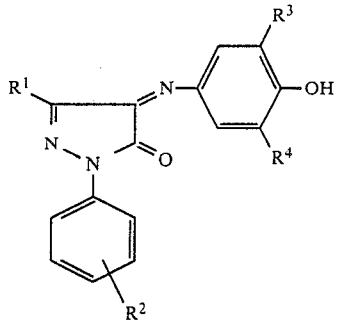
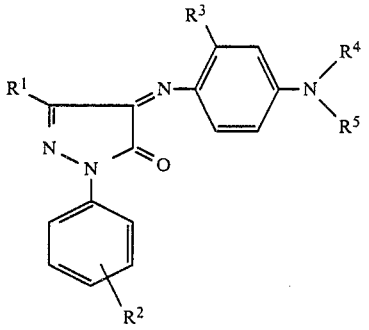
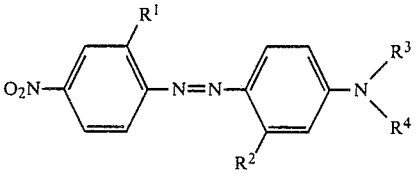
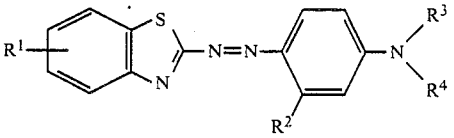
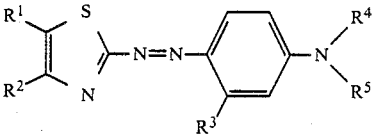
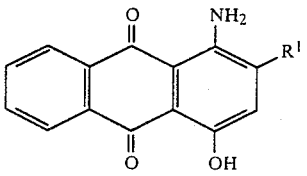
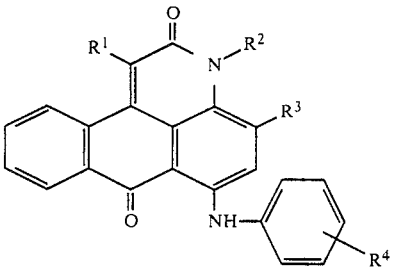
-continued
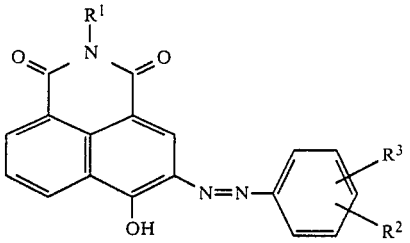
Cyan:
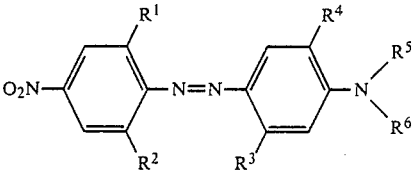
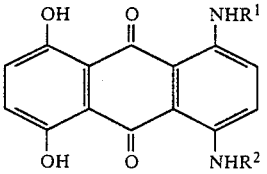
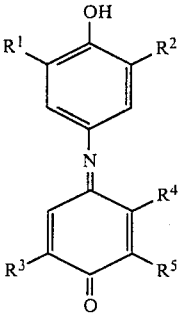
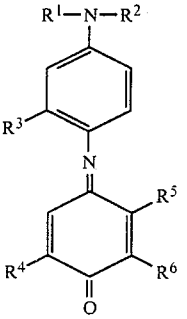
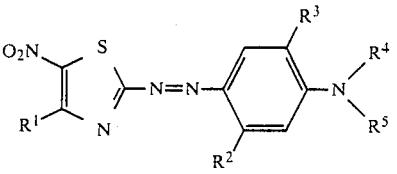
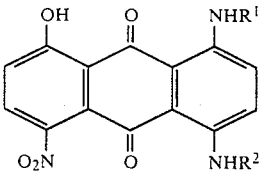

-continued

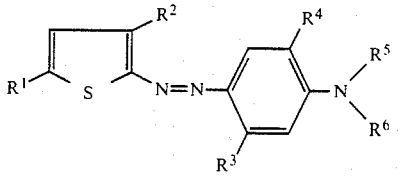

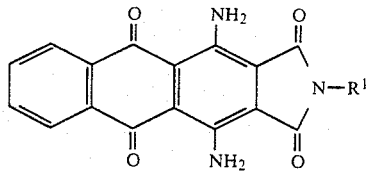

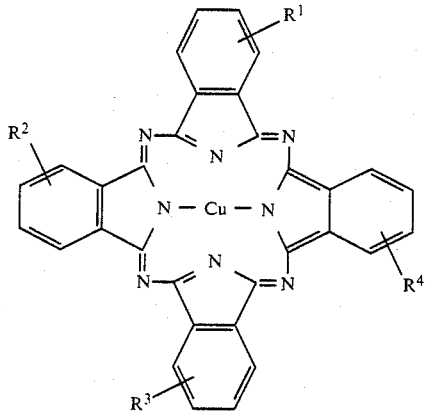

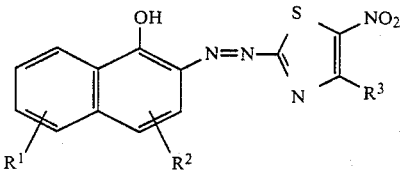

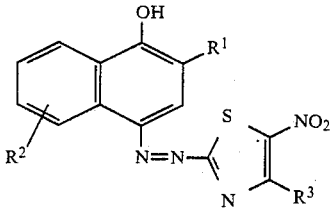

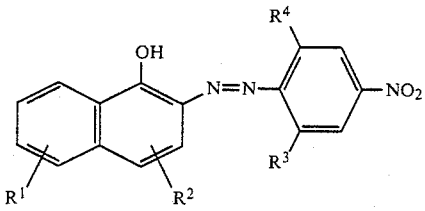

-continued

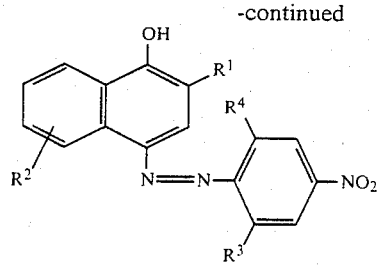

wherein $R^1$ to $R^6$, which may be the same or different, each represents hydrogen or a substituent selected from an alkyl group, a cycloalkyl group, an aralkyl group, an alkoxy group, an aryloxy group, an aryl group, an acylamino group, an acyl group, a cyano group, a hydroxy group, an alkylsulfonylamino group, an arylsulfonylamino group, an alkylsulfonyl group, a hydroxyalkyl group, a cyanoalkyl group, an alkoxycarbonylalkyl group, an aryloxyalkyl group, a nitro group, a halogen atom, a sulfamoyl group, an N-substituted sulfamoyl group, a carbamoyl group, an N-substituted carbamoyl group, an aryloxyalkyl group, an amino group, a substituted amino group, an alkylthio group or an arylthio group.

16. A heat-developable color photographic material as claimed in claim 15, wherein the alkyl moiety and the aryl moiety in the substituent for $R^1$ to $R^6$ is further substituted with a halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, an alkylsulfonylamino group, an arylsulfonylamino group or a ureido group.

17. A heat-developable color photographic material as claimed in claim 1, wherein an amount of the dye releasing compound is from 0.01 mol to 4 mols per mol of the silver.

18. A heat-developable color photographic material as claimed in claim 2, wherein the reducing agent is an auxiliary developing agent.

19. A heat-developable color photographic material as claimed in claim 18, wherein an amount of the auxiliary developing agent is from 0.01 time to 20 times by mol based on the silver.

20. A heat-developable color photographic material as claimed in claim 2, wherein an oxidized product of the reducing agent is capable of oxidizing the reducing group R in the dye releasing compound of claim 4.

21. A heat-developable color photographic material as claimed in claim 1, wherein the light-sensitive silver halide is silver chloride, silver chlorobromide, silver chloroiodide, silver bromide, silver iodobromide, silver chloroiodobromide or silver iodide.

22. A heat-developable color photographic material as claimed in claim 1, wherein the organic silver salt oxidizing agent is present in a range from 0.2 mol to 250 mols per mol of light-sensitive silver halide.

23. A heat-developable color photographic material as claimed in claim 1, wherein the particle size of the silver halide is from 0.001 μm to 2 μm.

24. A heat-developable color photographic material as claimed in claim 1, wherein the organic silver salt oxidizing agent is a silver salt which forms silver by reacting with the dye releasing compound, when it is heated to a temperature of above 80° C. in the presence of exposed silver halide.

25. A heat-developable color photographic material as claimed in claim 1, wherein the organic silver salt oxidizing agent is a silver salt of an organic compound having a carboxy group, a silver salt of a compound containing a mercapto group or a thione group or a silver salt of a compound containing an imino group.

26. A heat-developable color photographic material as claimed in claim 25, wherein the organic silver salt oxidizing agent is a silver salt of carboxylic acid derivatives or N-containing heterocyclic compounds.

27. A heat-developable color photographic material as claimed in claim 1, wherein the light-sensitive silver halide and the organic silver salt oxidizing agent are present in the same layer.

28. A heat-developable color photographic material as claimed in claim 1, wherein the hydrophilic binder is gelatin or a gelatin derivative.

29. A heat-developable color photographic material as claimed in claim 1, wherein the dye releasing activator is a base, a base releasing agent or a water releasing compound.

30. A heat-developable color photographic material as claimed in claim 29, wherein an amount of the dye releasing activator is from 1/100 time to 10 times by molar ratio based on silver.

31. A heat-developable color photographic material as claimed in claim 1, wherein the color light-sensitive material further contains a thermal solvent.

32. A heat-developable color photographic material as claimed in claim 1, wherein the color photographic material further comprises an image receiving layer capable of receiving the hydrophilic diffusible dye.

33. A heat-developable color photographic material as claimed in claim 32, wherein the image receiving layer contains a dye mordant.

34. A heat-developable color photographic material as claimed in claim 32, wherein the image receiving layer contains a polymer mordant and gelatin.

35. A heat-developable color photographic material as claimed in claim 1, wherein the color photographic material further contains a transfer solvent.

36. A heat-developable color photographic material as claimed in claim 35, wherein the transfer solvent is water or an alkaline aqueous solution.

37. A method of forming a color image which comprises imagewise exposing the heat-developable color photographic material as claimed in claim 1, developing by heating the photographic material at a temperature from 80° C. to 250° C. to release a hydrophilic diffusible dye and transferring the diffusible dye into an image receiving material.

38. A method of forming a color image as claimed in claim 37 wherein the transferring of the diffusible dye is carried out using a transfer solvent.

39. A method of forming a color image as claimed in claim 38, wherein the transfer solvent is water or an alkaline aqueous solution.

40. A method of forming a color image as claimed in claim 39, wherein the image receiving material contains a mordant for the diffusible dye.

* * * * *

UNITED STATES PATENT AND TRADEMARK OFFICE

CERTIFICATE OF CORRECTION

PATENT NO. : 4,500,626

DATED : February 19, 1985

INVENTOR(S) : Hideki Naito et al

It is certified that error appears in the above-identified patent and that said Letters Patent is hereby corrected as shown below:

On the title page, item /75/ delete "Shinsaku Fujita" as an inventor.

Column 72, Claim 12,

Lines 10, 34, and 44 kindly delete :T C-" and substitute therefor -- T----C- --.

Line 18, kindly delete : (-C-)" and substitute therefore -- (-C) --.

UNITED STATES PATENT AND TRADEMARK OFFICE

CERTIFICATE OF CORRECTION

PATENT NO. : 4,500,626 Page 2 of 2

DATED : February 19, 1985

INVENTOR(S) : Hideki Naito et al.

It is certified that error appears in the above-identified patent and that said Letters Patent is hereby corrected as shown below:

Column 72, Claim 13

Lines 53-60, kindly delete " 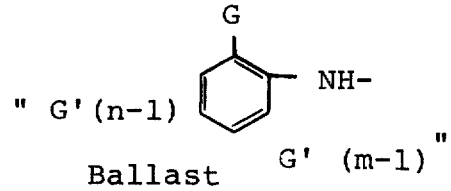

"

and substitute therefor

-- 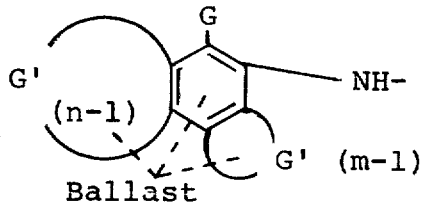

--.

Signed and Sealed this

*Nineteenth* Day of *November 1985*

[SEAL]

*Attest:*

DONALD J. QUIGG

*Attesting Officer* *Commissioner of Patents and Trademarks*